US009868125B2

(12) United States Patent
Macsay

(10) Patent No.: US 9,868,125 B2
(45) Date of Patent: Jan. 16, 2018

(54) MULTIFUNCTION PIVOTING BODY SPRAY

(71) Applicant: Moen Incorporated, North Olmsted, OH (US)

(72) Inventor: Steven M. Macsay, Strongsville, OH (US)

(73) Assignee: Moen Incorporated, North Olmsted, OH (US)

( * ) Notice: Subject to any disclaimer, the term of this patent is extended or adjusted under 35 U.S.C. 154(b) by 0 days.

(21) Appl. No.: 15/000,171

(22) Filed: Jan. 19, 2016

(65) Prior Publication Data

US 2016/0207053 A1 Jul. 21, 2016

Related U.S. Application Data

(60) Provisional application No. 62/105,144, filed on Jan. 19, 2015.

(51) Int. Cl.

| | |
|---|---|
| ***B05B 1/12*** | (2006.01) |
| ***B05B 1/16*** | (2006.01) |
| ***B05B 1/18*** | (2006.01) |
| ***B05B 15/06*** | (2006.01) |
| ***B05B 15/08*** | (2006.01) |
| ***B05B 3/04*** | (2006.01) |

(52) U.S. Cl.

CPC ..... *B05B 1/1663* (2013.01); *B05B 1/18* (2013.01); *B05B 3/04* (2013.01); *B05B 15/067* (2013.01)

(58) Field of Classification Search

CPC B05B 1/12; B05B 1/1636; B05B 1/18; B05B 1/185; B05B 3/04; B05B 15/065; B05B 15/066; B05B 15/067; B05B 15/069; B05B 15/08

USPC ..... 4/601, 605, 615; 239/282, 442–449, 239/587.1–587.6

See application file for complete search history.

(56) References Cited

U.S. PATENT DOCUMENTS

| | | | | |
|---|---|---|---|---|
| 2,697,839 | A | 12/1954 | Jackson | |
| 3,341,132 | A * | 9/1967 | Parkison | F16K 21/02 239/428.5 |
| 3,724,760 | A | 4/1973 | Smith | |
| 4,018,385 | A | 4/1977 | Bruno | |
| 4,303,201 | A * | 12/1981 | Elkins | B05B 1/1636 239/381 |
| 4,397,050 | A | 8/1983 | Davis et al. | |
| 4,901,927 | A * | 2/1990 | Valdivia | B05B 1/1636 137/883 |
| 4,955,101 | A | 9/1990 | King | |
| 5,065,942 | A | 11/1991 | Shannon | |
| 5,141,163 | A * | 8/1992 | Scheidler | B05B 1/185 239/553 |

(Continued)

OTHER PUBLICATIONS

Toto Soiree TS960J and Guinevere TS970J Body Sprays—Installation and Owner's Manual, the Toto Soiree TS960J and Guinevere TS970J body sprays and Installation and Owner's Manual are believed to have been publicly available at least as early as Jul. 14, 2008 (28 pages).

(Continued)

*Primary Examiner* — Darren W Gorman

(74) *Attorney, Agent, or Firm* — Calfee, Halter & Griswold LLP

(57) ABSTRACT

The present invention provides a multifunction pivoting body spray whose diverter assembly is upstream of and operates independently of its pivot assembly.

9 Claims, 25 Drawing Sheets

(56) References Cited

U.S. PATENT DOCUMENTS

| | | | | |
|---|---|---|---|---|
| 5,205,490 | A * | 4/1993 | Steinhardt | B05B 1/1636 137/874 |
| 5,450,647 | A | 9/1995 | Dorsey | |
| 5,561,869 | A | 10/1996 | Sarel | |
| 5,774,907 | A | 7/1998 | Doggwiler | |
| 6,042,027 | A | 3/2000 | Sandvik | |
| 6,148,453 | A | 11/2000 | Sartor | |
| 6,908,047 | B2 | 6/2005 | Saunders et al. | |
| 7,014,128 | B2 | 3/2006 | Leung | |
| 7,455,247 | B2 | 11/2008 | Kajuch | |
| 7,628,341 | B2 | 12/2009 | Kajuch | |
| 7,770,825 | B2 | 8/2010 | Kajuch | |
| 8,196,234 | B2 | 6/2012 | Glunk | |
| 8,360,346 | B2 | 1/2013 | Furseth | |
| 8,714,463 | B2 * | 5/2014 | Bischoff | A61H 33/6063 239/209 |
| 9,242,262 | B2 | 1/2016 | Huffington et al. | |
| 9,579,667 | B2 | 2/2017 | Evans et al. | |
| 2005/0156062 | A1 * | 7/2005 | Thomas | E03C 1/084 239/548 |
| 2006/0196972 | A1 * | 9/2006 | Kajuch | B05B 1/18 239/451 |
| 2009/0114739 | A1 * | 5/2009 | Furseth | E03C 1/0408 239/243 |
| 2010/0276518 | A1 * | 11/2010 | Kajuch | B05B 1/3026 239/538 |
| 2012/0248222 | A1 * | 10/2012 | Evans | B05B 15/067 239/455 |
| 2013/0312175 | A1 * | 11/2013 | Huffington | B05B 15/067 4/615 |

OTHER PUBLICATIONS

Grohe Movario 28 522 Body Spray, the Grohe Movario 28 522 body spray is believed to have been publicly available prior to Jan. 19, 2014 (1 page).

Kohler K-8509 Body Spray, the Kohler K-8509 body spray is believed to have been publicly available prior to Jan. 19, 2014 (1 page).

American Standard 1660.13 Body Spray, the American Standard 1660.13 body spray is believed to have been publicly available prior to Jan. 19, 2014 (1 page).

Grohe Relexa Ultra 27 070 Body Spray, the Grohe Relexa Ultra 27 070 body spray is believed to have been publicly available prior to Jan. 19, 2014 (1 page).

Kohler K-8510 Body Spray, the Kohler K-8510 body spray is believed to have been publicly available prior to Jan. 19, 2014 (1 page).

American Standard 1660.125 Body Spray, the American Standard 1660.125 body spray is believed to have been publicly available prior to Jan. 19, 2014 (1 page).

* cited by examiner 52
48

48

48

52

48

52
48
TOP

48

48

50
54
56
58
60

82/84
202
202
74/76

74/76

74/76

82/84
74/76

86/88
74/76

74/76

78/80
74/76

70
90
94
96
98
100
102
104
106
108
110
112

118
116
72

72

72

118
116
72

72

72

114
114
72

MULTIFUNCTION PIVOTING BODY SPRAY

CROSS-REFERENCE TO RELATED APPLICATION

This application claims the benefit of U.S. Provisional Application No. 62/105,144, filed Jan. 19, 2015, the entire disclosure of which is hereby incorporated by reference.

FIELD

The present invention relates generally to a multifunction pivoting body spray, and, more particularly, to a multifunction pivoting body spray whose diverter assembly is upstream of and operates independently of its pivot assembly.

BACKGROUND

Multifunction body sprays include a mechanism for switching from one function to another function. Additionally, multifunction body sprays can include a mechanism for pivoting the body spray. Actuation of the switching mechanism can cause accidental actuation of the pivoting mechanism.

SUMMARY

The present invention provides a multifunction pivoting body spray. In an exemplary embodiment, the body spray comprises a diverter assembly and a pivot assembly. The diverter assembly includes a first flow path, a second flow path, and a diverter mechanism. The diverter mechanism is operable to divert fluid flow between the first flow path and the second flow path. The pivot assembly includes a first pivot axis, a second pivot axis, and a pivot mechanism. The pivot mechanism is operable to pivot on the first pivot axis and the second pivot axis. The diverter assembly is upstream of the pivot assembly. The diverter assembly operates independently of the pivot assembly.

The present invention provides a multifunction pivoting body spray. In an exemplary embodiment, the body spray comprises a diverter assembly, a pivot assembly, and a spray assembly. The diverter assembly includes a first flow path, a second flow path, and a diverter mechanism. The diverter mechanism is operable to divert fluid flow between the first flow path and the second flow path. The pivot assembly includes a first pivot axis, a second pivot axis, and a pivot mechanism. The pivot mechanism is operable to pivot on the first pivot axis and the second pivot axis. The spray assembly includes a first set of nozzles, a second set of nozzles, and a spray head mechanism. The first set of nozzles is operable to receive fluid flow from the first flow path of the diverter assembly and deliver a first type of spray from the spray assembly. The second set of nozzles is operable to receive fluid flow from the second flow path of the diverter assembly and deliver a second type of spray from the spray assembly. The spray head mechanism is operable to direct the first set of nozzles and the second set of nozzles in a plurality of spray directions. The diverter assembly diverts fluid flow between the first set of nozzles and the second set of nozzles upon actuation of the diverter mechanism. The spray assembly moves the first set of nozzles and the second set of nozzles from a first spray direction to a second spray direction upon actuation of the pivot mechanism. The diverter assembly is upstream of the pivot assembly. The diverter assembly operates independently of the pivot assembly.

The present invention provides a multifunction pivoting body spray. In an exemplary embodiment, the body spray comprises a housing assembly, a diverter assembly, a pivot assembly, a spray assembly, and an escutcheon assembly. The housing assembly includes a housing. The diverter assembly includes a first flow path, a second flow path, and a diverter mechanism. The diverter mechanism is operable to divert fluid flow between the first flow path and the second flow path. The pivot assembly includes a first pivot axis, a second pivot axis, and a pivot mechanism. The pivot mechanism is operable to pivot on the first pivot axis and the second pivot axis. The spray assembly includes a first set of nozzles, a second set of nozzles, and a spray head mechanism. The first set of nozzles is operable to receive fluid flow from the first flow path of the diverter assembly and deliver a first type of spray from the spray assembly. The second set of nozzles is operable to receive fluid flow from the second flow path of the diverter assembly and deliver a second type of spray from the spray assembly. The spray head mechanism is operable to direct the first set of nozzle and the second set of nozzles in a plurality of spray directions. The escutcheon assembly includes an escutcheon and an actuator mechanism. The escutcheon is operable to interface with the housing. The actuator mechanism is operable to interface with the diverter mechanism. The diverter assembly diverts fluid flow between the first set of nozzles and the second set of nozzles upon movement of the actuator mechanism which results in actuation of the diverter mechanism. The spray assembly moves the first set of nozzles and the second set of nozzles from a first spray direction to a second spray direction upon movement of the spray head mechanism which results in actuation of the pivot mechanism. The diverter assembly is upstream of the pivot assembly. The diverter assembly operates independently of the pivot assembly.

BRIEF DESCRIPTION OF THE DRAWINGS

-FIG. 5*a* is a perspective view, FIG. 5*b* is a front view, FIG. 5*c* is a rear view, FIG. 5*d* is a left view, FIG. 5*e* is a right view, FIG. 5*f* is a top view, and FIG. 5*g* is a bottom view;

-FIG. 6*a* is a perspective view, FIG. 6*b* is a front view, FIG. 6*c* is a rear view, FIG. 6*d* is a left view, FIG. 6*e* is a right view, FIG. 6*f* is a top view, and FIG. 6*g* is a bottom view;

FIGS. 9*a*-9*g* are views of the pivot support of FIG. 8-FIG. 9*a* is a perspective view, FIG. 9*b* is a front view, FIG. 9*c* is a rear view, FIG. 9*d* is a left view, FIG. 9*e* is a right view, FIG. 9*f* is a top view, and FIG. 9*g* is a bottom view;

-FIG. 10*a* is a perspective view, FIG. 10*b* is a front view, FIG. 10*c* is a rear view, FIG. 10*d* is a left view, FIG. 10*e* is a right view, FIG. 10*f* is a top view, and FIG. 10*g* is a bottom view;

-FIG. 11*a* is a perspective view, FIG. 11*b* is a front view, FIG. 11*c* is a rear view, FIG. 11*d* is a left view, FIG. 11*e* is a right view, FIG. 11*f* is a top view, and FIG. 11*g* is a bottom view;

—FIG. 16*a* is a front view, FIG. 16*b* is a cross-sectional view taken along the line 16*b*-16*b* in FIG. 16*a*, FIG. 16*c* is a cross-sectional view taken along the line 16*c*-16*c* in FIG. 16*a*, and FIG. 16*d* is a cross-sectional view taken along the line 16*d*-16*d* in FIG. 16*b;*

—FIG. 17*a* is a front view, FIG. 17*b* is a cross-sectional view taken along the line 17*b*-17*b* in FIG. 17*a*, FIG. 17*c* is a cross-sectional view taken along the line 17*c*-17*c* in FIG. 17*a*, and FIG. 17*d* is a cross-sectional view taken along the line 17*d*-17*d* in FIG. 17*b*; -FIG. 18*a* is a cross-sectional view taken along a vertical line through a center of the spray face (similar to line 16*b*-16*b* in FIG. 16*a* and line 17*b*-17*b* in FIG. 17*a*), and FIG. 18*b* is a cross-sectional view taken along a horizontal line through the center of the spray face (similar to line 16*c*-16*c* in FIG. 16*a* and line 17*c*-17*c* in FIG. 17*a*).

DETAILED DESCRIPTION

Figure 1:
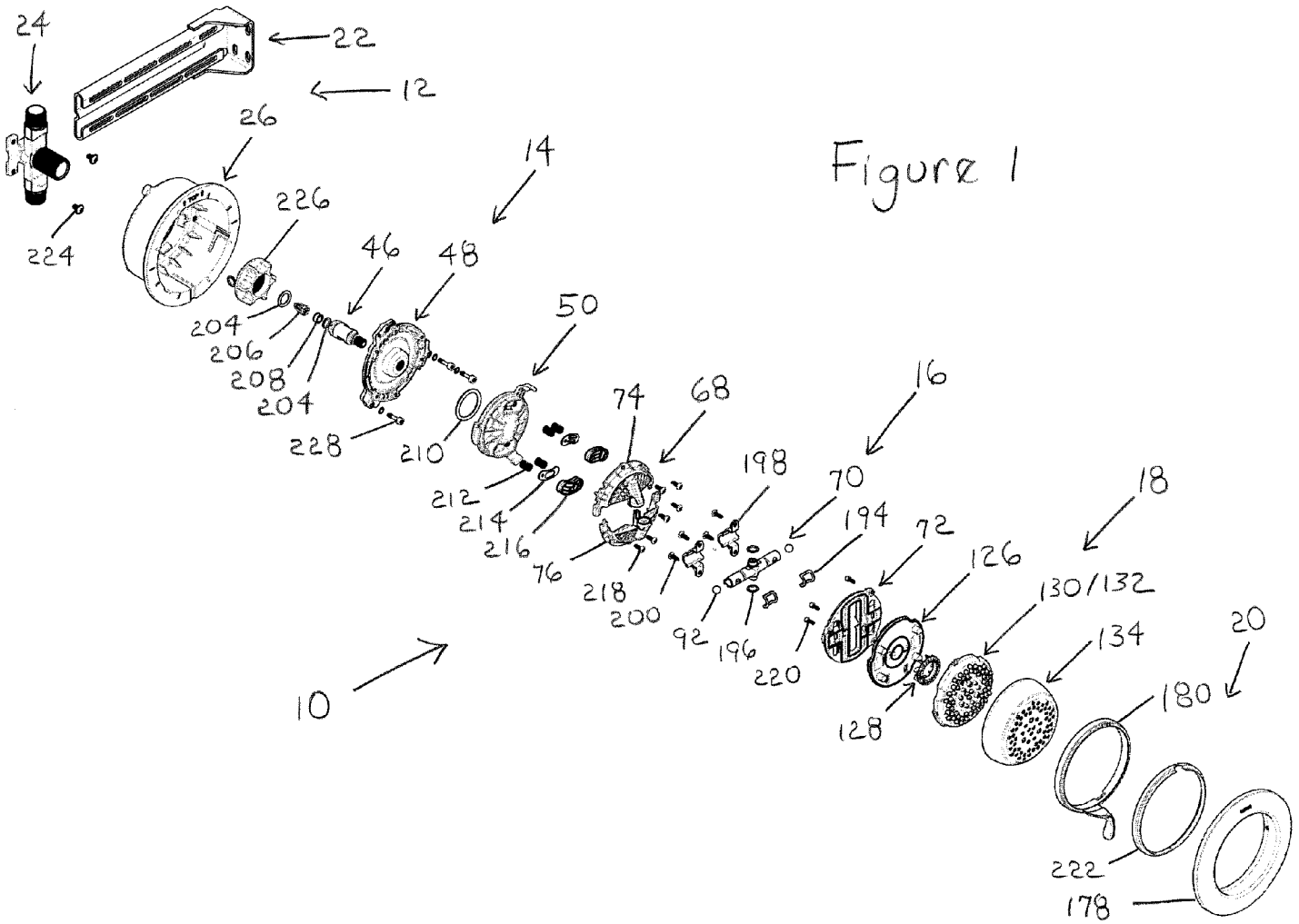
FIG. 1 is an exploded perspective view of a multifunction pivoting body spray, including a housing assembly, a diverter assembly, a pivot assembly, a spray assembly, and an escutcheon assembly, according to an exemplary embodiment of the present invention.

The present invention provides a multifunction pivoting body spray whose diverter assembly is upstream of and operates independently of its pivot assembly. Exemplary embodiments of a multifunction pivoting body spray 10 of the present invention are shown in FIGS. 1-18*b*. In the illustrated embodiments, the body spray 10 includes a housing assembly 12, a diverter assembly 14, a pivot assembly 16, a spray assembly 18, and an escutcheon assembly 20.

Figure 2:
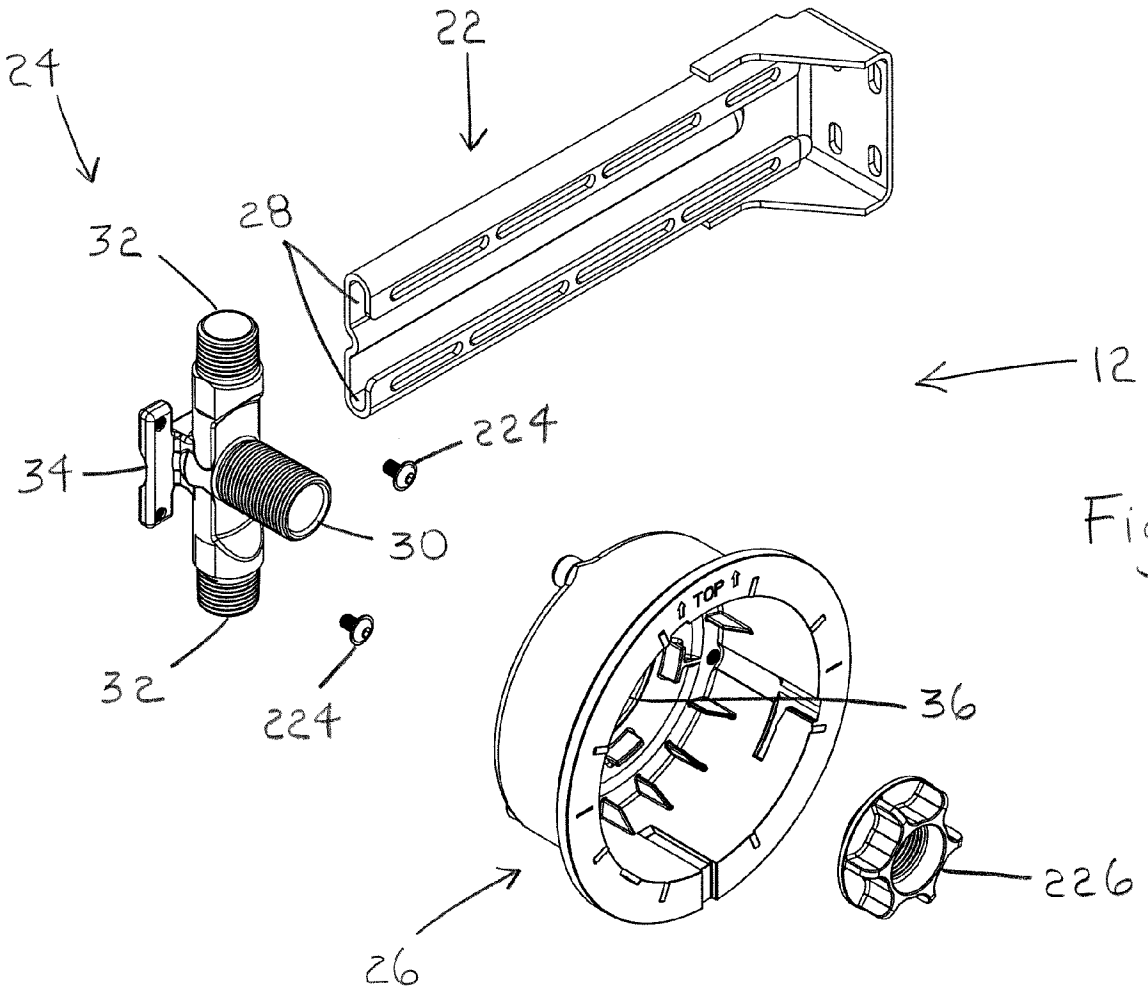
FIG. 2 is an exploded perspective view of the housing assembly of FIG. 1.
Figure 3:
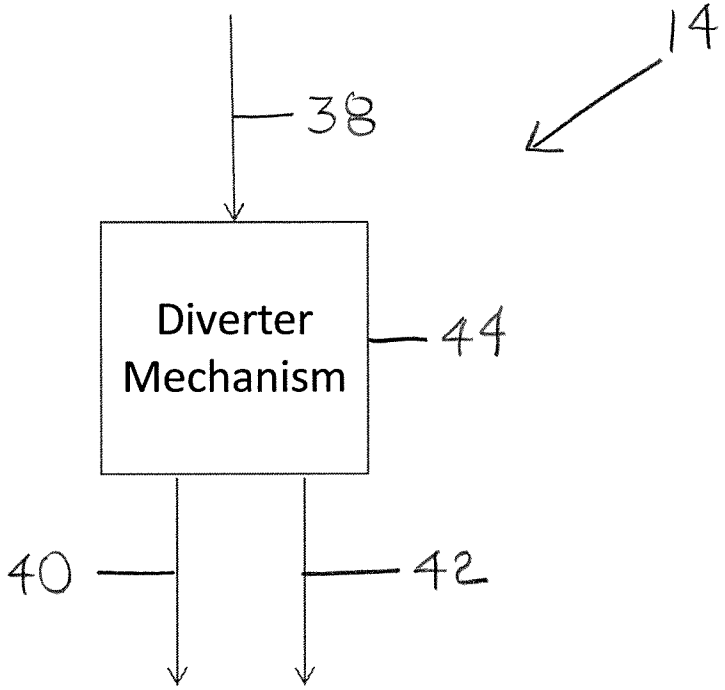
FIG. 3 is an illustration of a diverter assembly according to an exemplary embodiment of the present invention.
Figure 4:
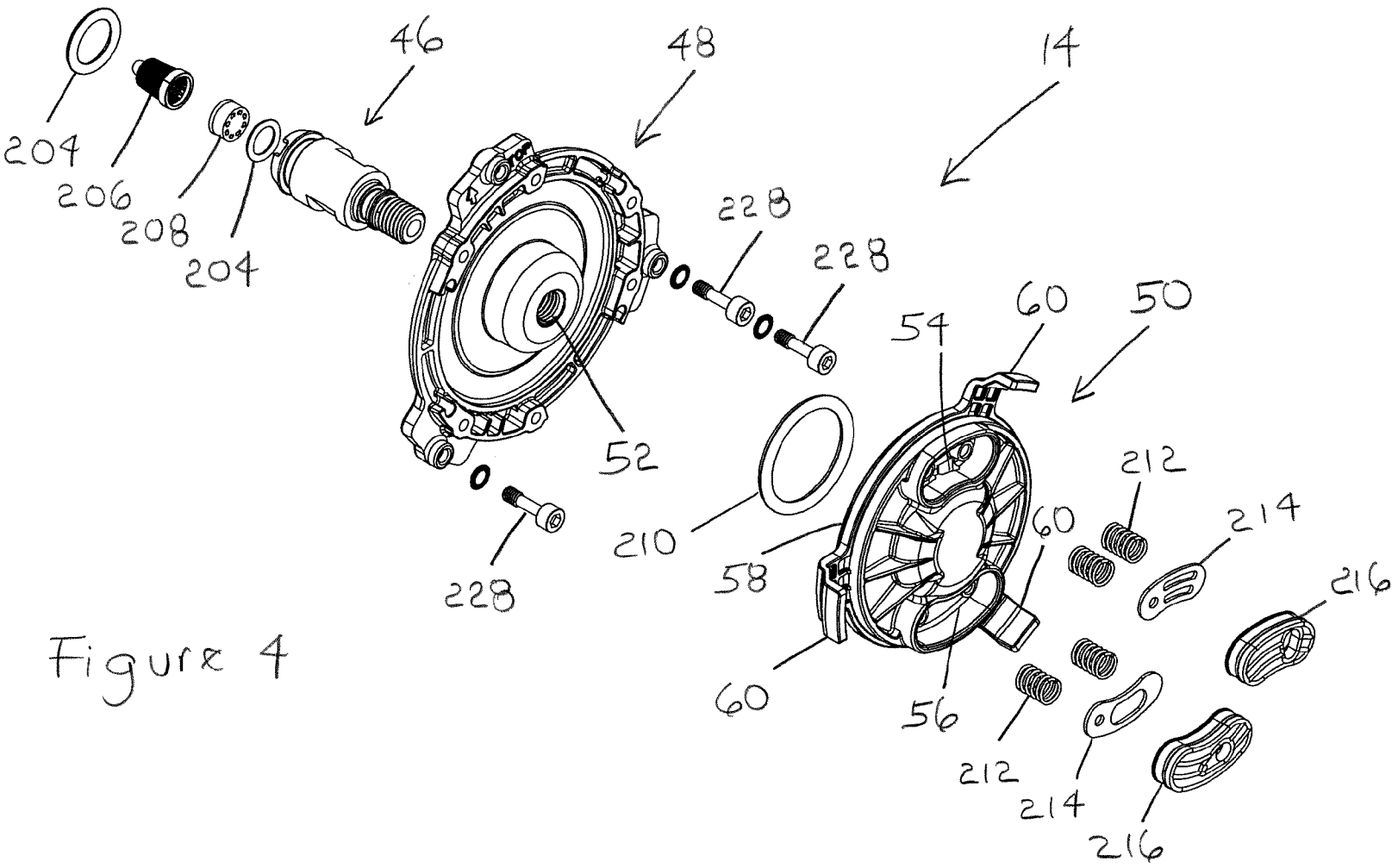
FIG. 4 is an exploded perspective view of the diverter assembly of FIG. 1, including a stem, a mounting plate, and a rotor plate.
Figures 5A, 5B, 5C, 5D, 5E, 5F, 5G:
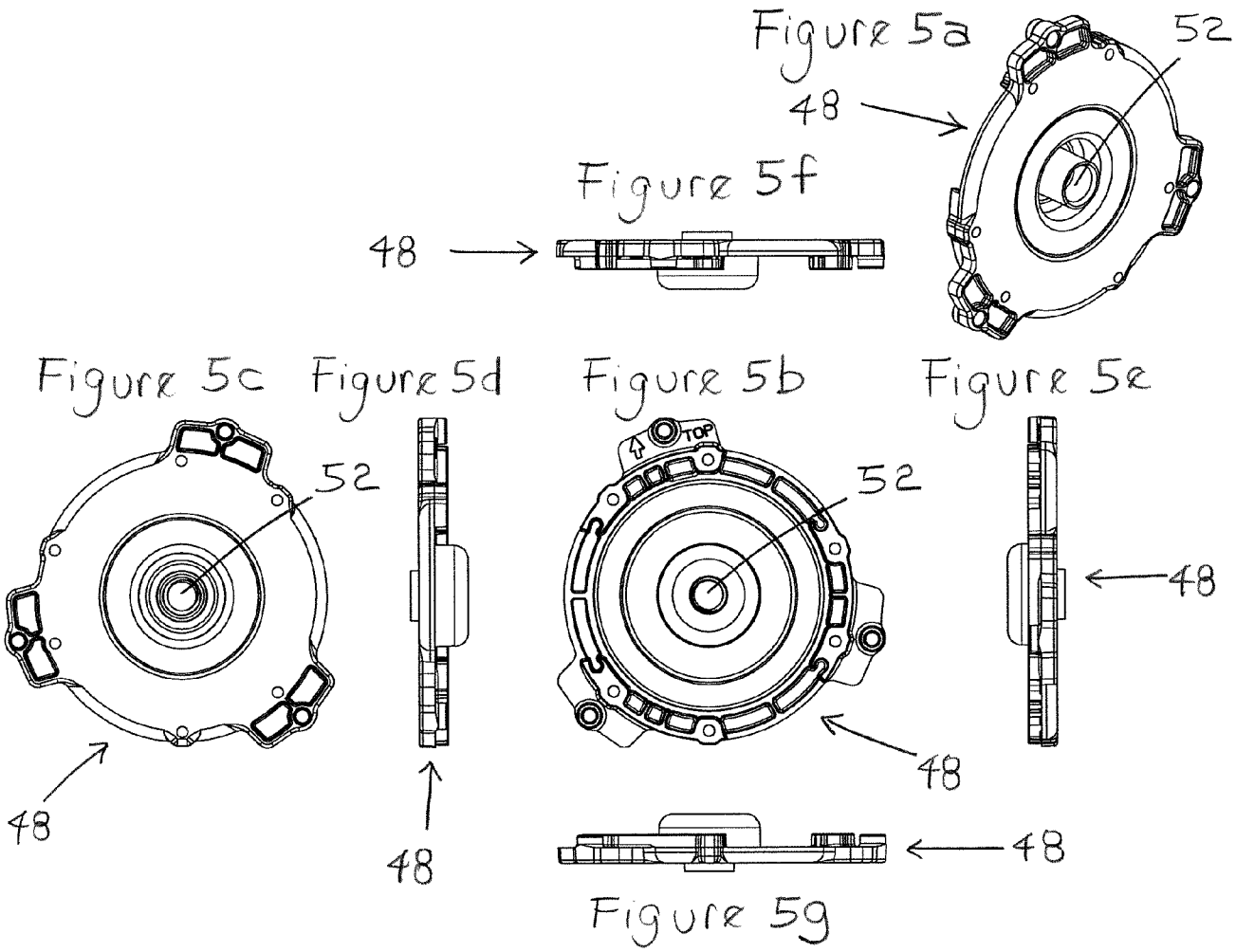
FIGS. 5*a*-5*g* are views of the mounting plate of FIG. 4
Figures 6A, 6B, 6C, 6D, 6E, 6F, 6G:
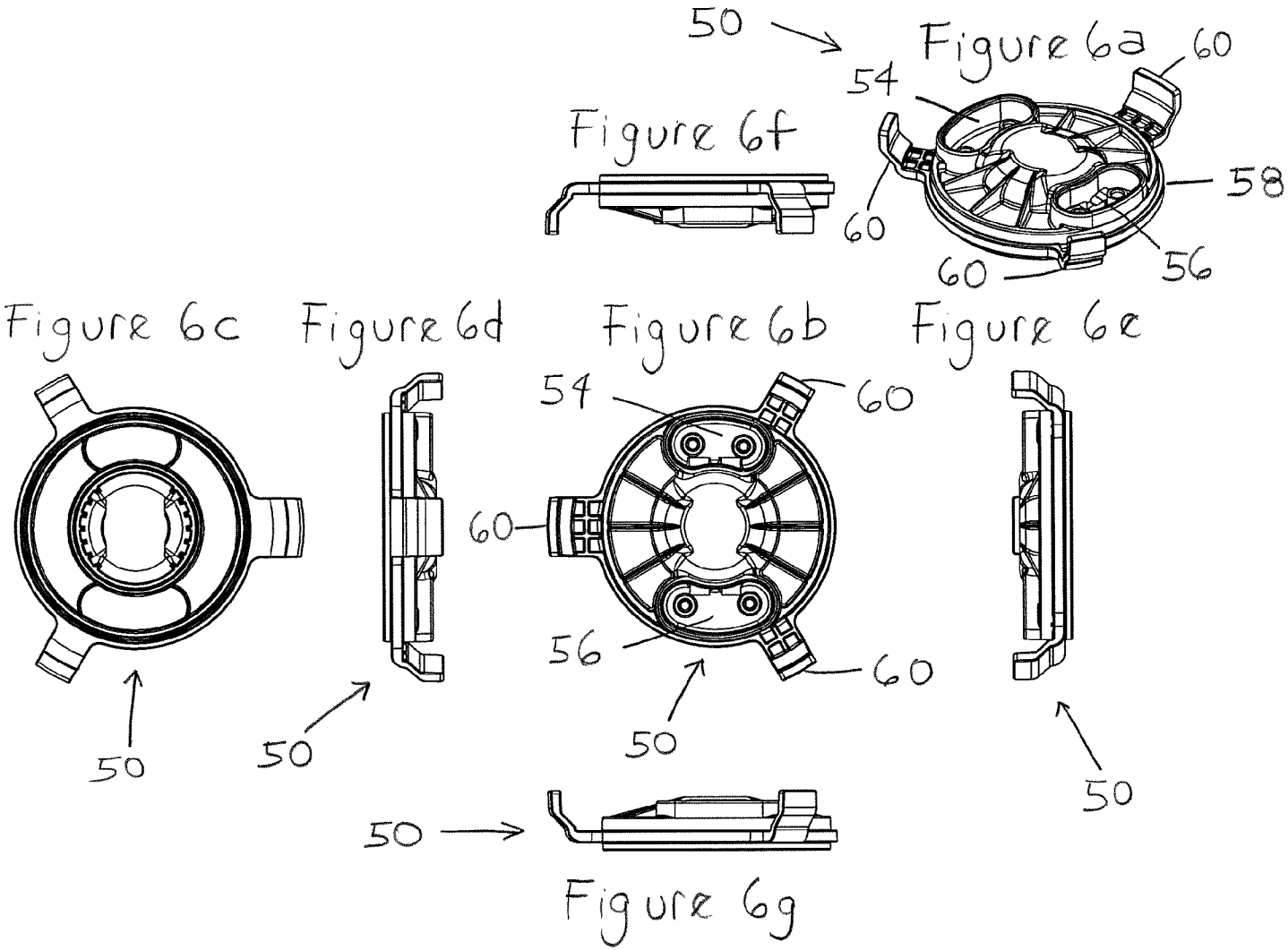
FIGS. 6*a*-6*g* are views of the rotor plate of FIG. 4
Figure 7:
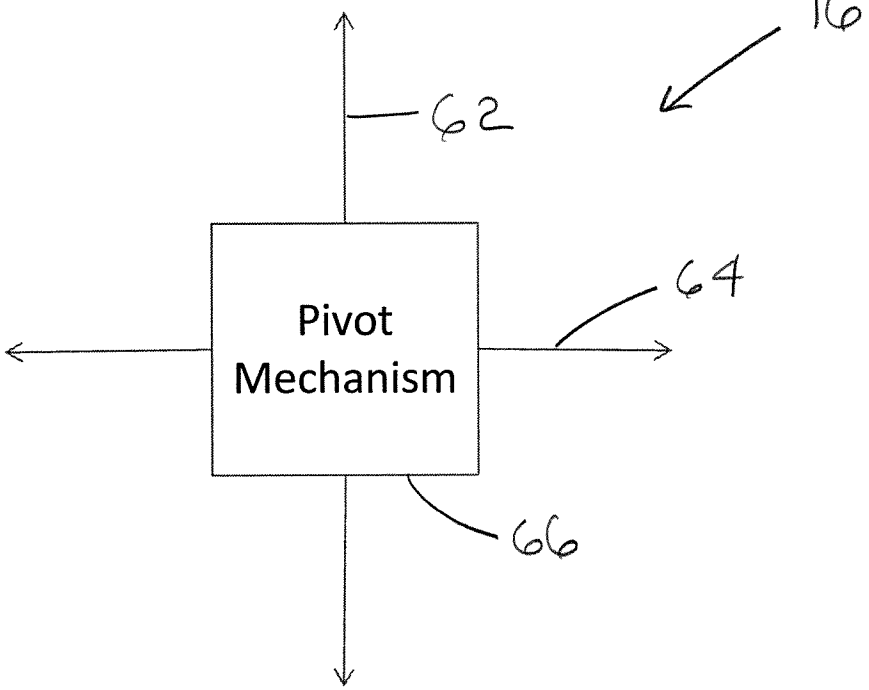
FIG. 7 is an illustration of a pivot assembly according to an exemplary embodiment of the present invention.
Figure 8:
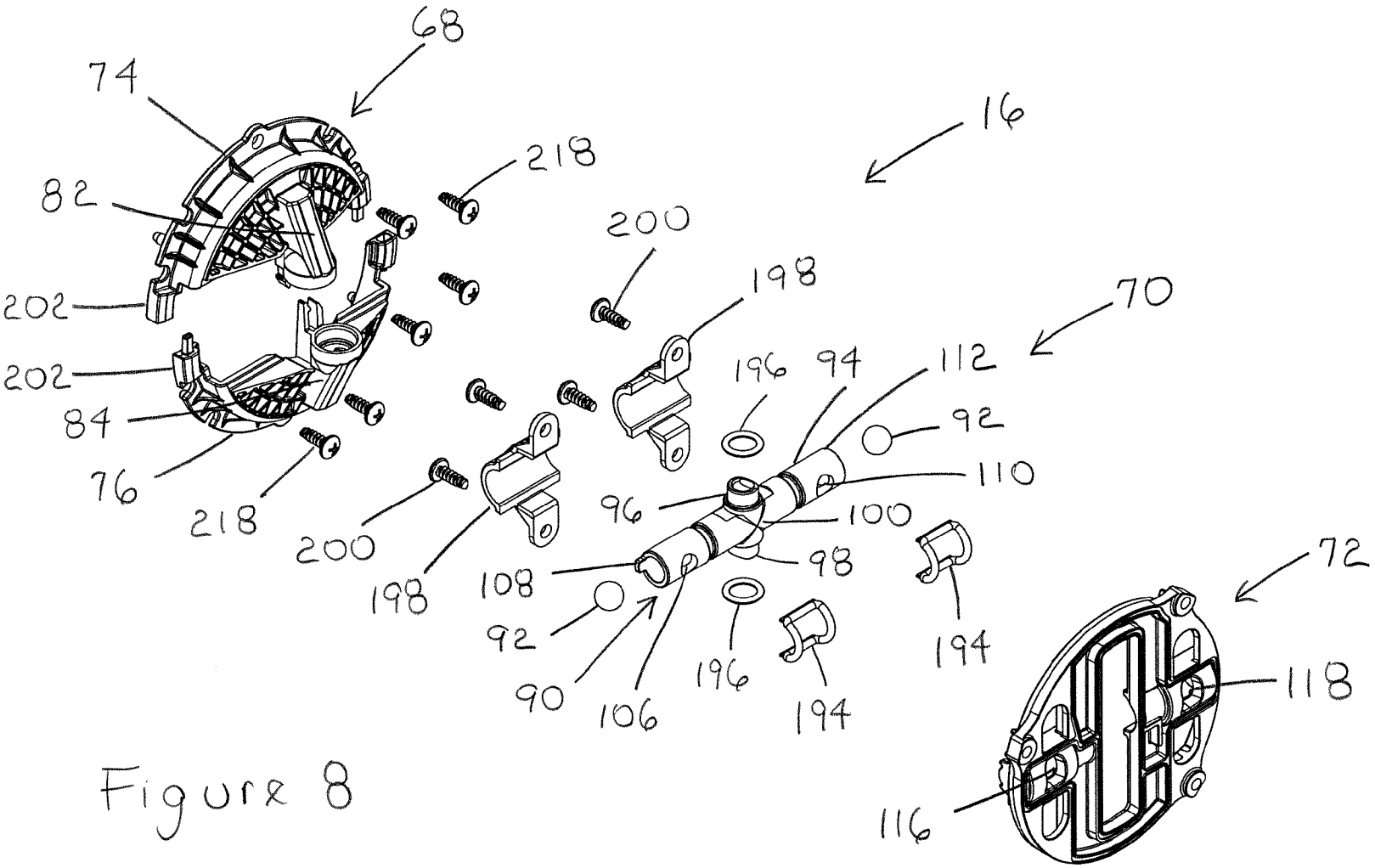
FIG. 8 is an exploded perspective view of the pivot assembly of FIG. 1, including a pivot support, a pivot, and a pivot plate.
Figures 9A, 9B, 9C, 9D, 9F, 9G:
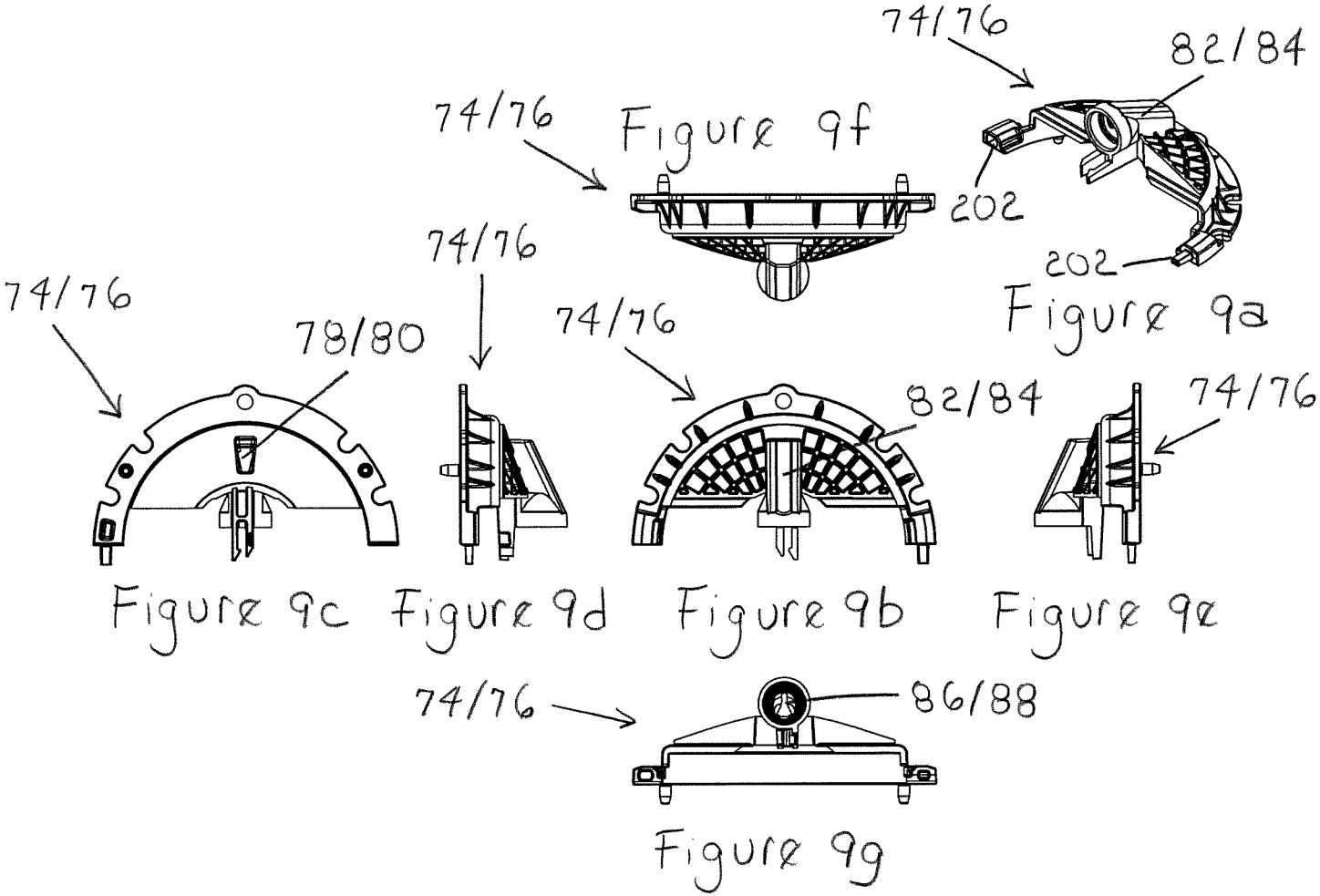
Figures 10A, 10B, 10C, 10D, 10E, 10F, 10G:
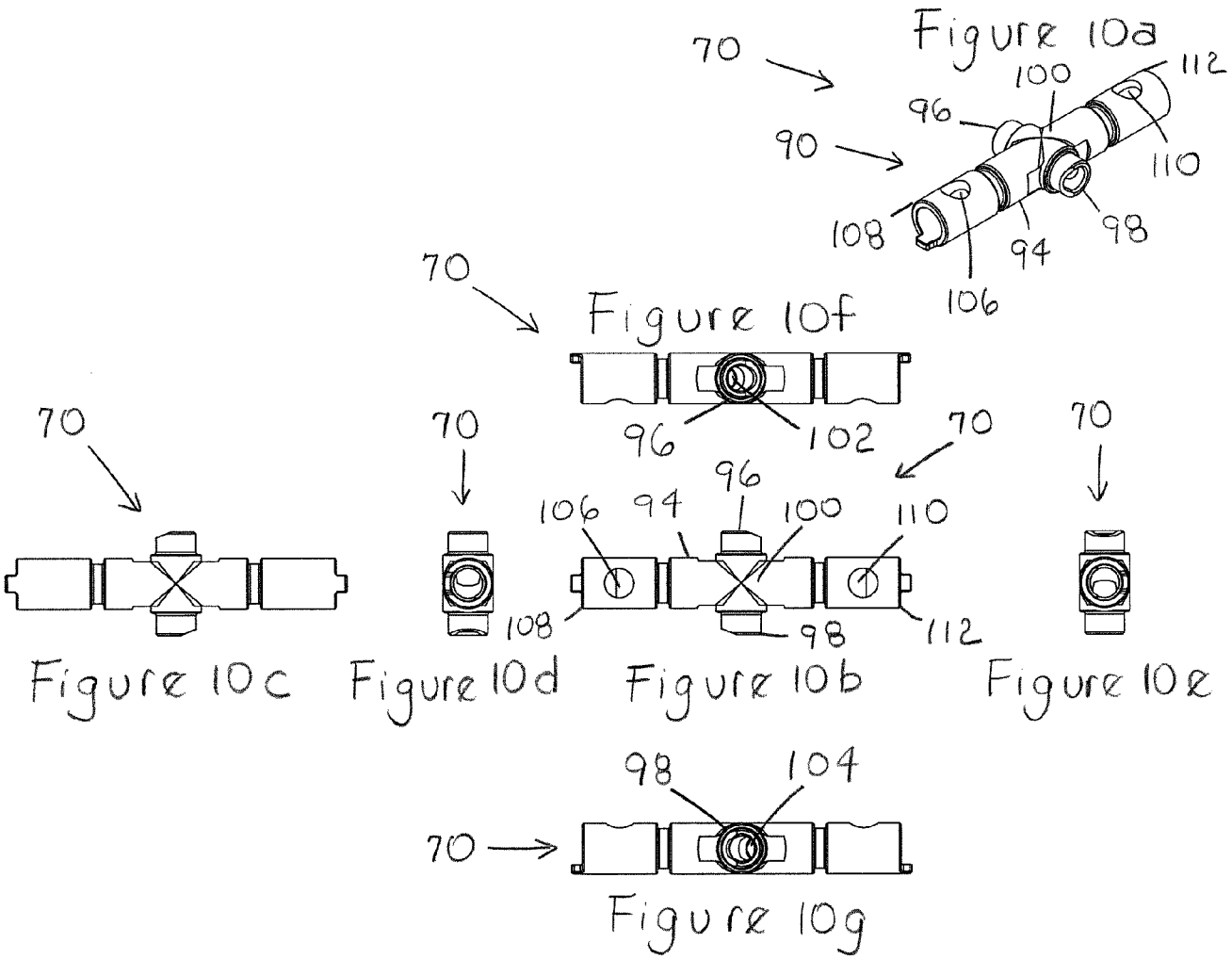
FIGS. 10*a*-10*g* are views of the pivot of FIG. 8
Figures 11A, 11B, 11C, 11D, 11E, 11F, 11G:
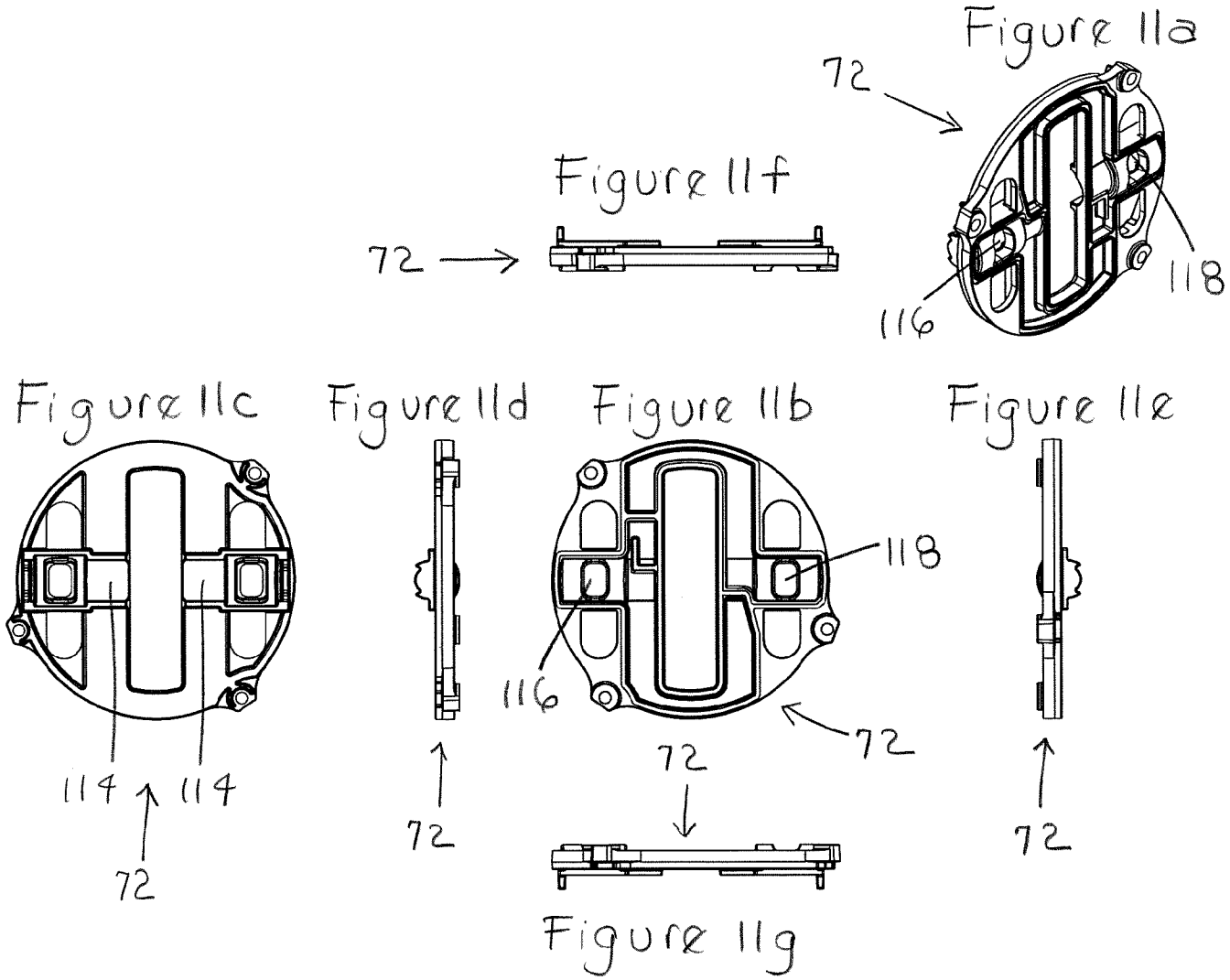
FIGS. 11*a*-11*g* are views of the pivot plate of FIG. 8

An exemplary embodiment of the housing assembly 12 is shown in detail in FIGS. 1 and 2. In the illustrated embodiment of FIGS. 1 and 2, the housing assembly 12 includes a bracket 22, a connector 24, and a housing 26. The bracket 22 includes a channel 28. The connector 24 includes a generally horizontal port 30 for receiving a portion of the diverter assembly 14. The connector 24 also includes one or more generally vertical ports 32 for connection to a water supply and, if desired, to other body sprays in a shower. The connector 24 further includes a flange 34. The connector 24 is attached to the bracket 22 using the flange 34. The flange 34 on the connector 24 moves in the channel 28 on the bracket 22. Although the housing assembly 12 has been illustrated as having the flange 34 on the connector 24 that moves in the channel 28 on the bracket 22, one of ordinary skill in the art will appreciate that the housing assembly 12 could include other structure that enables the connector 24 to move relative to the bracket 22. The housing 26 includes a central opening 36. The housing 26 is mounted in an opening in a mounting surface, such as a wall.

Exemplary embodiments of the diverter assembly 14 are shown in detail in FIGS. 1 and 3-6*g*. In the illustrated embodiment of FIG. 3, the diverter assembly 14 includes an incoming flow path 38, a first flow path 40, a second flow path 42, and a diverter mechanism 44. The diverter mechanism 44 is operable to divert fluid flow from the incoming flow path 38 between the first flow path 40 and the second flow path 42. As used herein, diverting fluid flow between the first flow path 40 and the second flow path 42 includes diverting fluid flow to: (1) only the first flow path 40, (2) only the second flow path 42, or (3) both the first flow path 40 and the second flow path 42.

In the illustrated embodiment of FIGS. 1 and 4-6*g*, the diverter assembly 14 includes a stem 46, a mounting plate 48, and a rotor plate 50. As shown in detail in FIGS. 5*a*-5*g*, the mounting plate 48 includes a central opening 52. As shown in detail in FIGS. 6*a*-6*g*, the rotor plate 50 includes a first opening 54 and a second opening 56. The first opening 54 and the second opening 56 in the rotor plate 50 are offset from the central opening 52 in the mounting plate 48. The rotor plate 50 also includes an outer ring 58 with a plurality of projections 60 extending therefrom. In the illustrated embodiment, the rotor plate 50 has three projections 60 extending therefrom. In the illustrated embodiment of FIGS. 1 and 4-6*g*, the diverter mechanism 44 includes the rotor plate 50.

Exemplary embodiments of the pivot assembly 16 are shown in detail in FIGS. 1 and 7-11*g*. In the illustrated embodiment of FIG. 7, the pivot assembly 16 includes a first pivot axis 62, a second pivot axis 64, and a pivot mechanism 66. The pivot mechanism 66 is operable to pivot on the first pivot axis 62 and the second pivot axis 64. The first pivot axis 62 is in a first pivot plane, and the second pivot axis 64 is in a second pivot plane. In an exemplary embodiment, the first pivot plane is the same as the second pivot plane. As a result, the pivot mechanism 66 is operable to pivot in any direction.

In the illustrated embodiment of FIGS. 1 and 8-11*g*, the pivot assembly 16 includes a pivot support 68, a pivot 70, and a pivot plate 72.

As shown in greater detail in FIGS. 9*a*-9*g*, the pivot support 68 includes a first portion 74 and a second portion 76. The first portion 74 of the pivot support 68 includes a first opening 78. The second portion 76 of the pivot support 68 includes a second opening 80. The first opening 78 in the first portion 74 of the pivot support 68 communicates with the first opening 54 in the rotor plate 50. The second opening 80 in the second portion 76 of the pivot support 68 communicates with the second opening 56 in the rotor plate 50. The first portion 74 of the pivot support 68 also includes a first arm 82. The second portion 76 of the pivot support 68 also includes a second arm 84. The first arm 82 of the first portion 74 of the pivot support 68 includes a first passageway 86 therethrough. The second arm 84 of the second portion 76 of the pivot support 68 includes a second passageway 88 therethrough. The first passageway 86 of the first arm 82 communicates with the first opening 78 in the first portion 74 of the pivot support 68. The second passageway 88 of the second arm 84 communicates with the second opening 80 in the second portion 76 of the pivot support 68.

As shown in greater detail in FIGS. 10*a*-10*g*, the pivot 70 includes a pivot body 90 and two end caps 92 (see FIG. 1). The pivot body 90 includes a generally cylindrical portion 94 having a first port 96 and a second port 98 near a middle 100 thereof. The first port 96 of the pivot body 90 communicates with the first arm 82 of the first portion 74 of the pivot support 68. The second port 98 of the pivot body 90 communicates with the second arm 84 of the second portion 76 of the pivot support 68. The pivot body 90 also includes a first passageway 102 and a second passageway 104 therethrough. The first passageway 102 of the pivot body 90 communicates with the first port 96 of the pivot body 90. The second passageway 104 of the pivot body 90 communicates with the second port 98 of the pivot body 90. The pivot body 90 further includes a first opening 106 near a first end 108 and a second opening 110 near a second end 112. The first opening 106 in the pivot body 90 communicates with the first passageway 102 of the pivot body 90. The second opening 110 in the pivot body 90 communicates with the second passageway 104 of the pivot body 90.

As shown in greater detail in FIGS. 11*a*-11*g*, the pivot plate 72 includes a generally cylindrical recess 114 for receiving a portion of the pivot 70. The pivot plate 72 also includes a first opening 116 and a second opening 118 in the recess. The first opening 116 in the recess communicates with the first opening 106 in the pivot body 90. The second opening 118 in the recess communicates with the second opening 110 in the pivot body 90.

In the illustrated embodiment of FIGS. 1 and 8-11*g*, the pivot mechanism 66 includes the pivot support 68, the pivot 70, and the pivot plate 72.

Figure 12:
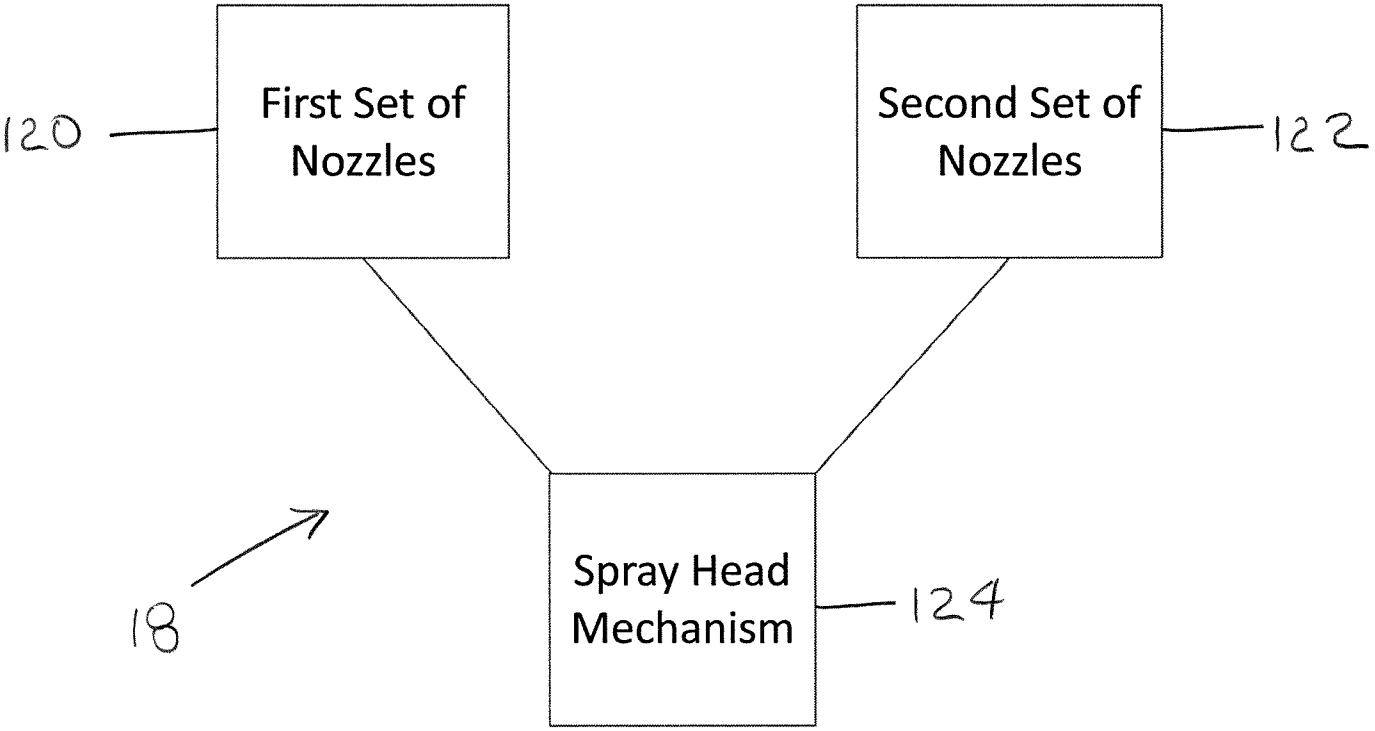
FIG. 12 is an illustration of a spray assembly according to an exemplary embodiment of the present invention.
Figure 13:
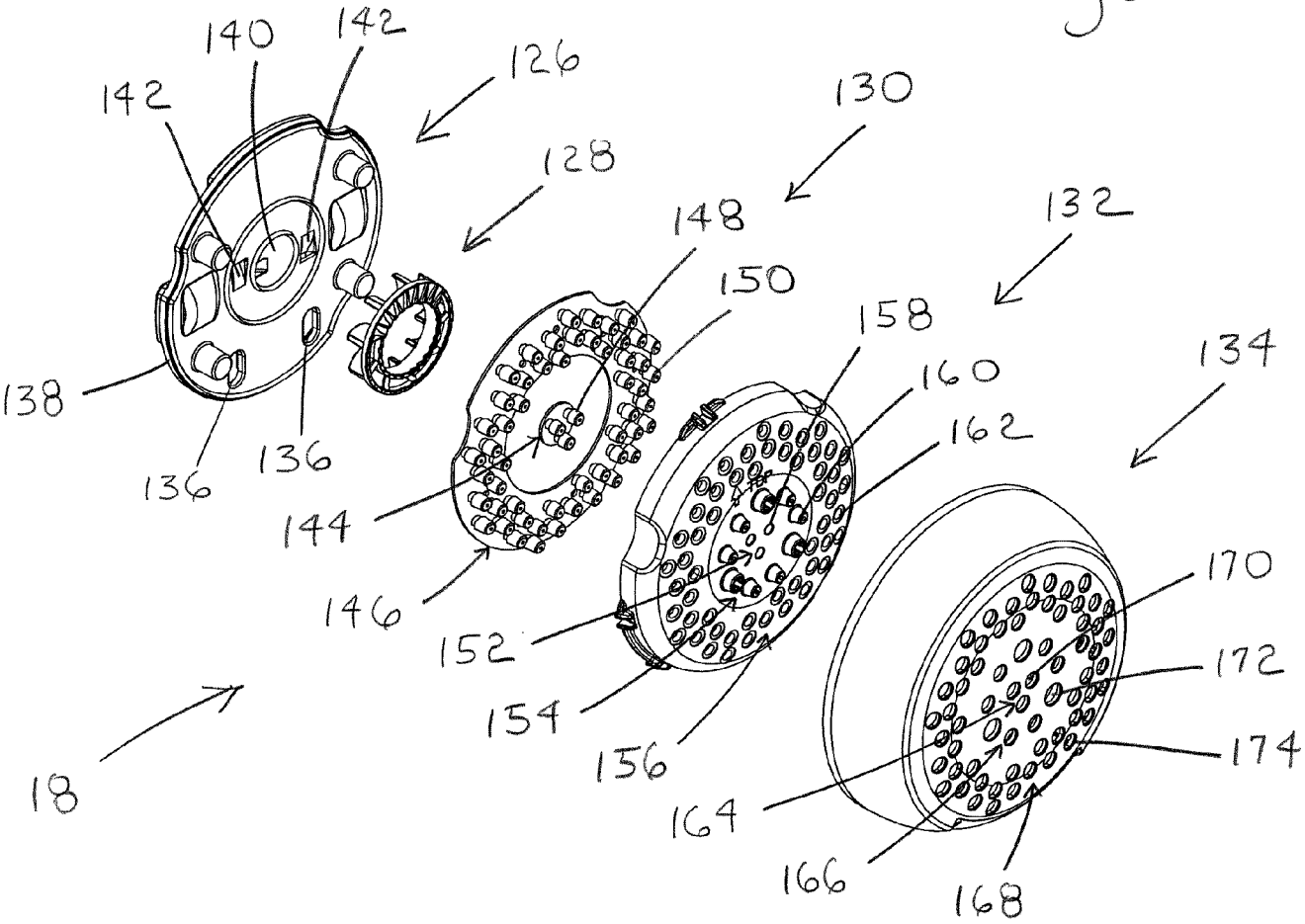
FIG. 13 is an exploded perspective view of the spray assembly of FIG. 1, including a rear plate, a turbine, a nubbin plate, a front plate, and a spray face.

Exemplary embodiments of the spray assembly 18 are shown in detail in FIGS. 1 and 12-13. In the illustrated embodiment of FIG. 12, the spray assembly 18 includes a first set of nozzles 120, a second set of nozzles 122, and a spray head mechanism 124. The first set of nozzles 120 is operable to receive fluid flow from the first flow path 40 of the diverter assembly 14 and deliver a first type of spray from the spray assembly 18. The second set of nozzles 122 is operable to receive fluid flow from the second flow path 42 of the diverter assembly 14 and deliver a second type of spray from the spray assembly 18. The spray head mechanism 124 is operable to direct the first set of nozzles 120 and the second set of nozzles 122 in a plurality of spray directions.

In the illustrated embodiment of FIGS. 1 and 13, the spray assembly 18 includes a rear plate 126, a turbine 128, a nubbin plate 130, a front plate 132, and a spray face 134.

The rear plate 126 includes two openings 136 near a perimeter 138 thereof. The rear plate 126 also includes a central opening 140. The rear plate 126 further includes two openings 142 offset from the central opening 140. The two openings 136 near the perimeter 138 and the central opening 140 in the rear plate 126 communicate with the first opening in the pivot plate 72. The two openings 142 offset from the central opening 140 in the rear plate 126 communicate with the second opening in the pivot plate 72. The turbine 128 communicates with the two openings 142 offset from the central opening 140 in the rear plate 126.

The nubbin plate 130 includes a central portion 144 and an outer ring 146. The central portion 144 of the nubbin plate 130 includes a plurality of nubbins 148 (three as illustrated), and the outer ring 146 of the nubbin plate 130 includes a plurality of nubbins 150 (fifty-three as illustrated). The nubbins 148 in the central portion 144 and the nubbins 150 in the outer ring 146 of the nubbin plate 130 communicate with the central opening 140 in the rear plate 126 and the two openings 136 near the perimeter 138, respectively.

The front plate 132 includes a central portion 152, a middle ring 154, and an outer ring 156. The central portion 152 of the front plate 132 includes a plurality of openings 158 (three as illustrated), the middle ring 154 of the front plate 132 includes a plurality of nozzles 160 (nine as illustrated), and the outer ring 156 of the front plate 132 includes a plurality of openings 162 (fifty-three as illustrated). The nozzles 160 in the middle ring 154 of the front plate 132 communicate with the two openings 142 offset from the central opening 140 in the rear plate 126. The nubbins 148 in the central portion 144 and the nubbins 150 in the outer ring 146 of the nubbin plate 130 extend through the openings 158 in the central portion 152 and the openings 162 in the outer ring 156 of the front plate 132, respectively.

The spray face 134 includes a central portion 164, a middle ring 166, and an outer ring 168. The central portion 164 of the spray face 134 includes a plurality of openings 170 (three as illustrated), the middle ring 166 of the spray face 134 includes a plurality of openings 172 (nine as illustrated), and the outer ring 168 of the spray face 134 includes a plurality of openings 174 (fifty-three as illustrated). The nubbins 148 in the central portion 144 and the nubbins 150 in the outer ring 146 of the nubbin plate 130 extend through the openings 170 in the central portion 164 and the openings 174 in the outer ring 168 of the spray face 134, respectively. The nozzles 160 in the middle ring 154 of the front plate 132 extend through the openings 172 in the middle ring 166 of the spray face 134.

In the illustrated embodiment of FIGS. 1 and 13, the spray head mechanism 124 includes the spray face 134.

Figure 14:
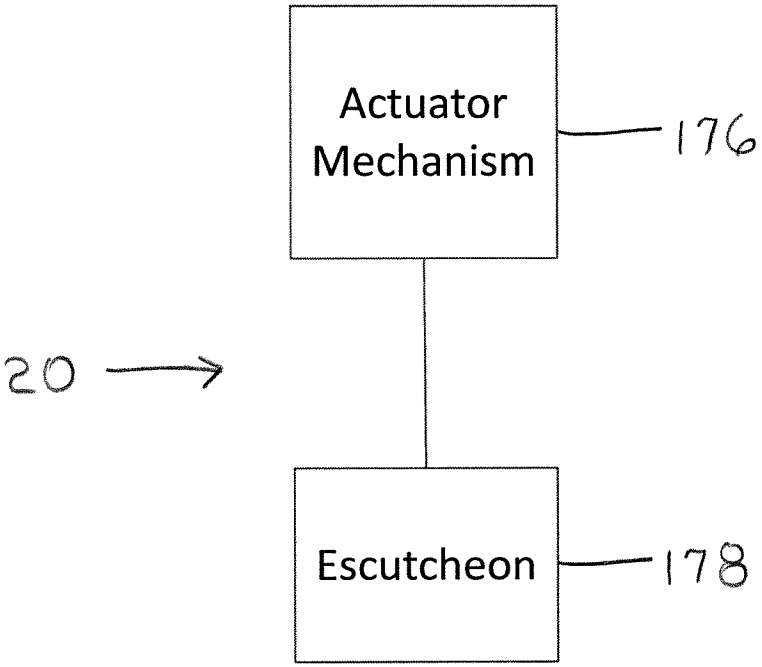
FIG. 14 is an illustration of an escutcheon assembly according to an exemplary embodiment of the present invention.
Figure 15:
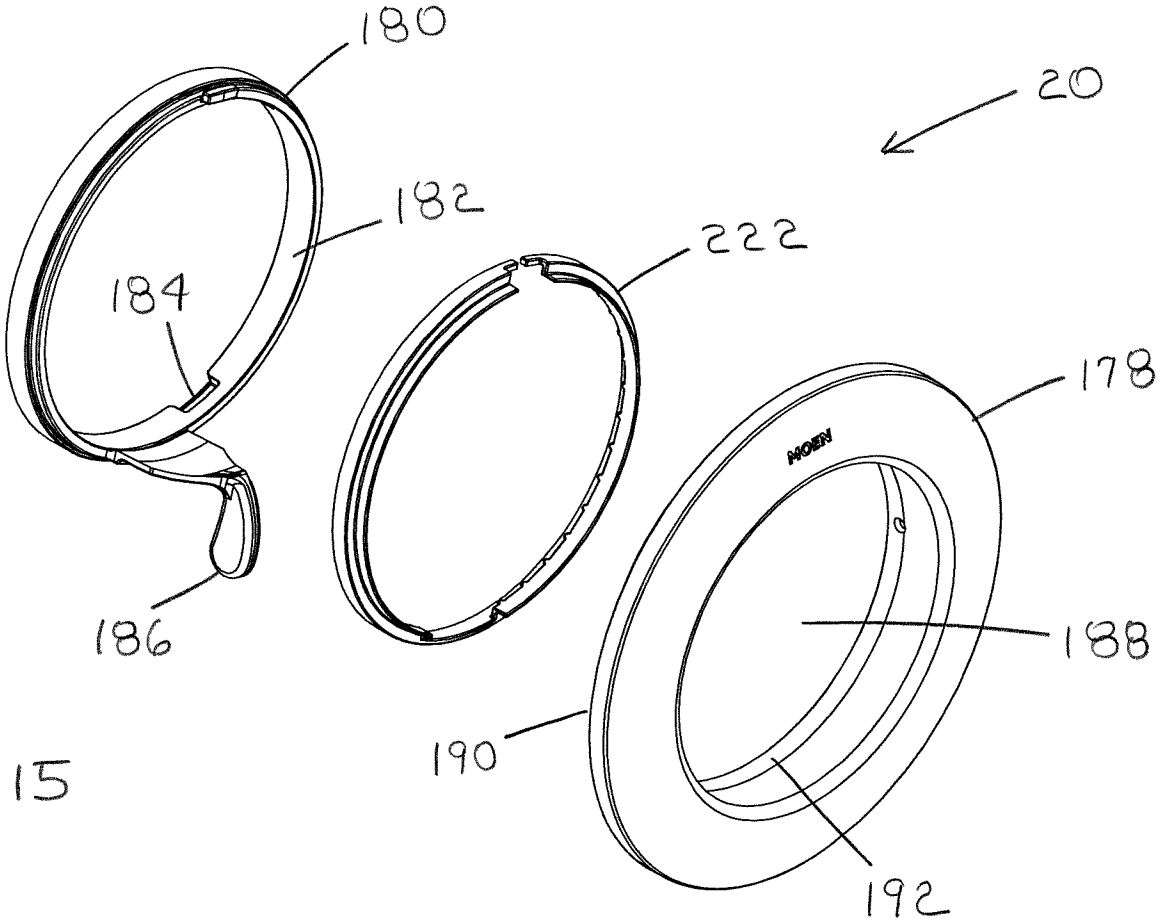
FIG. 15 is an exploded perspective view of the escutcheon assembly of FIG. 1, including an escutcheon and an actuator ring.
Figure 16A:
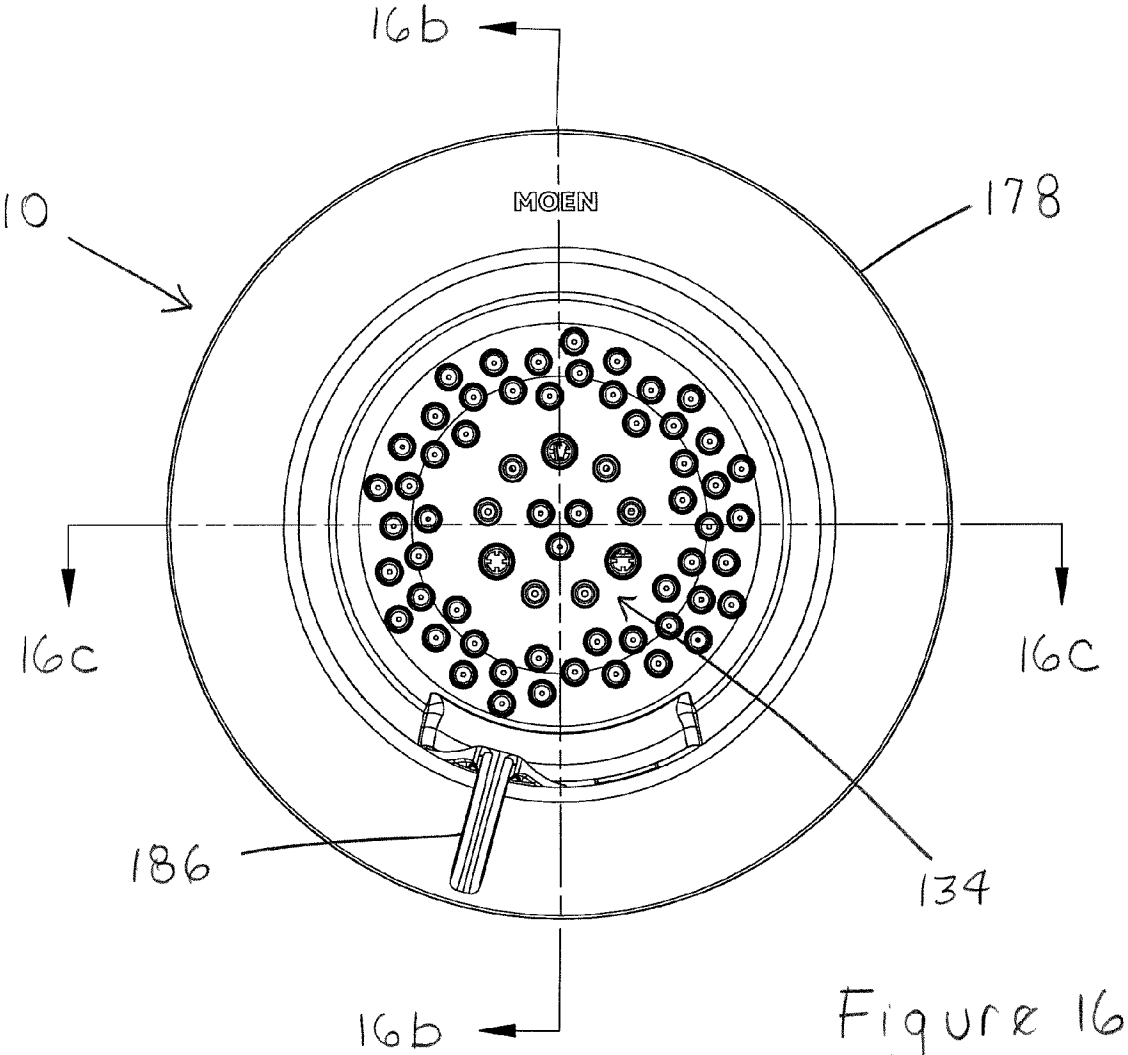
FIGS. 16*a*-16*d* are views of the assembled body spray of FIG. 1 in a spray mode
Figure 16B:
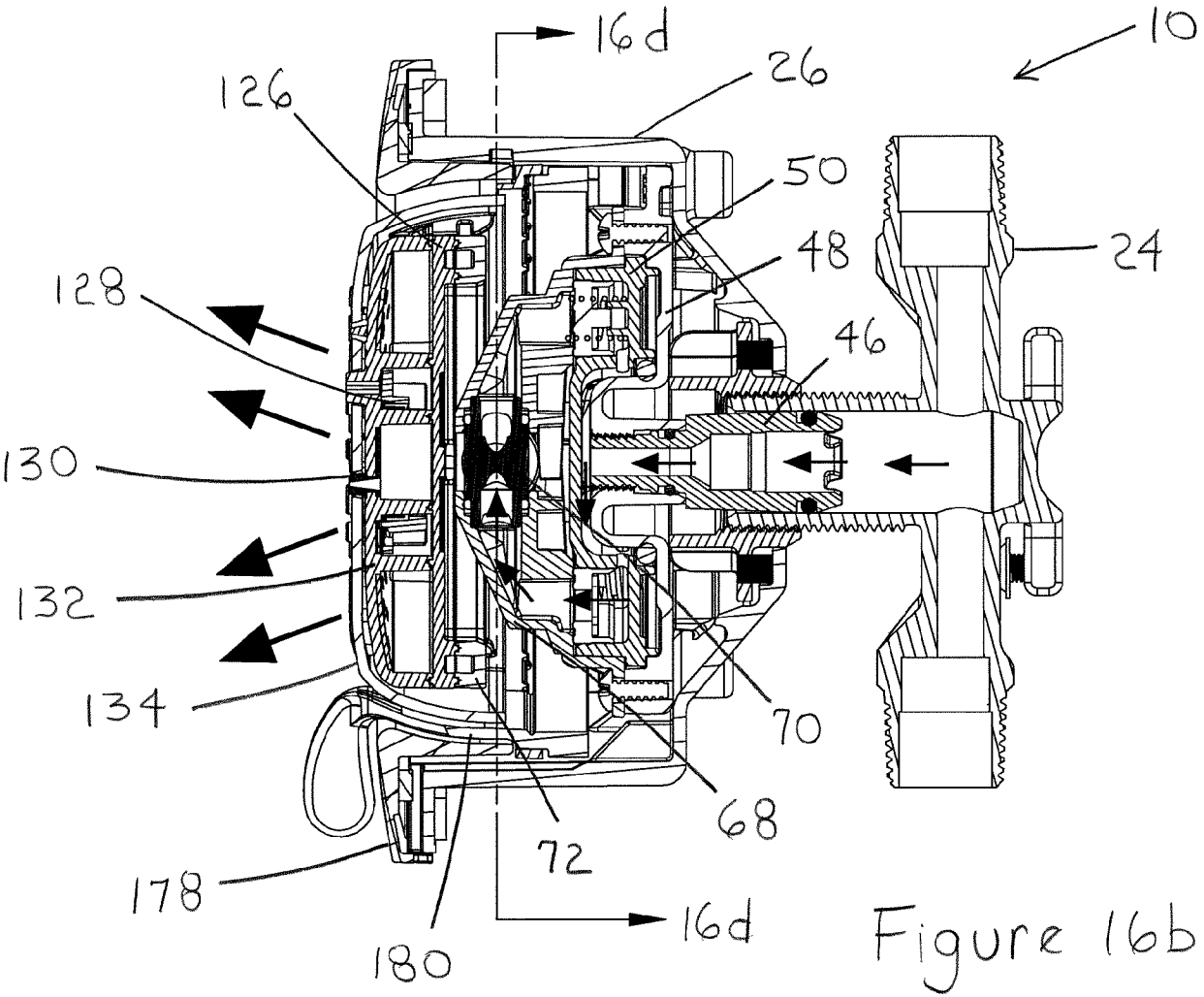
Figure 16C:
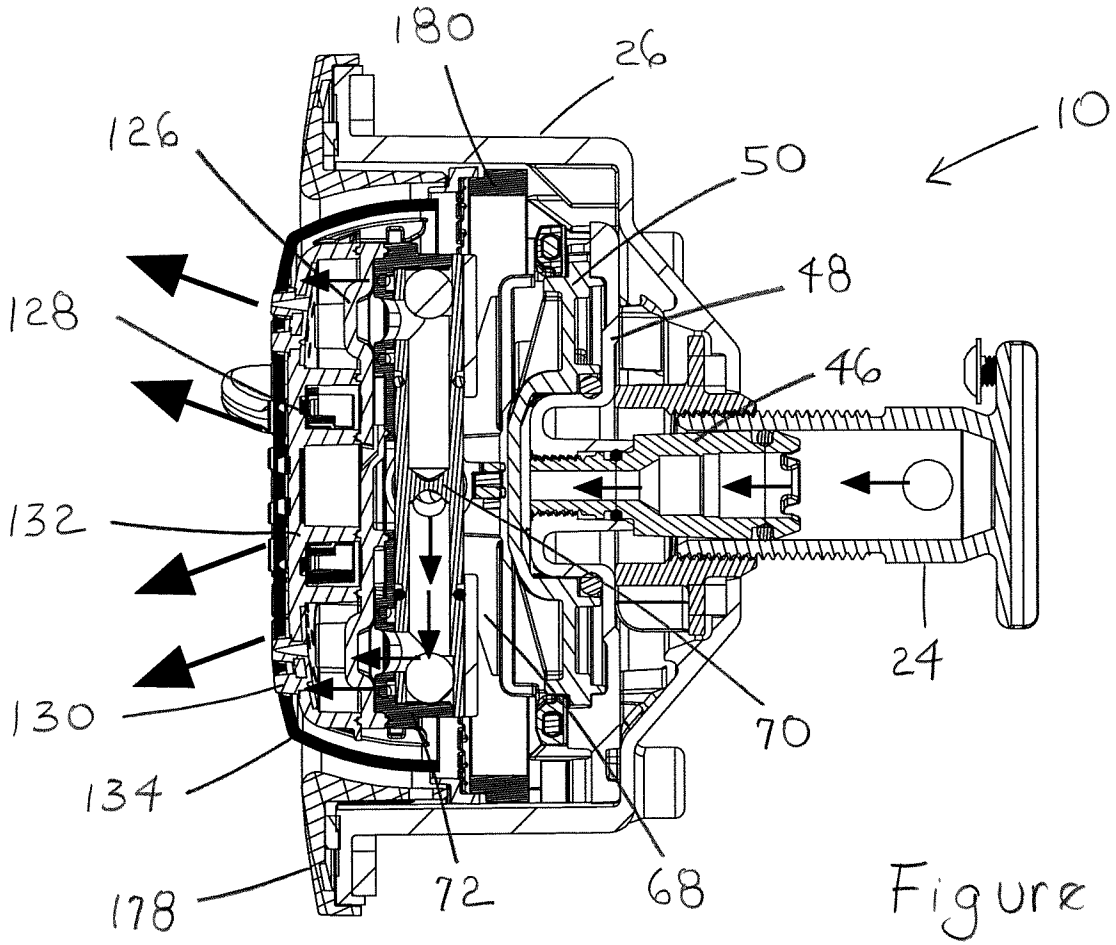
Figure 16D:
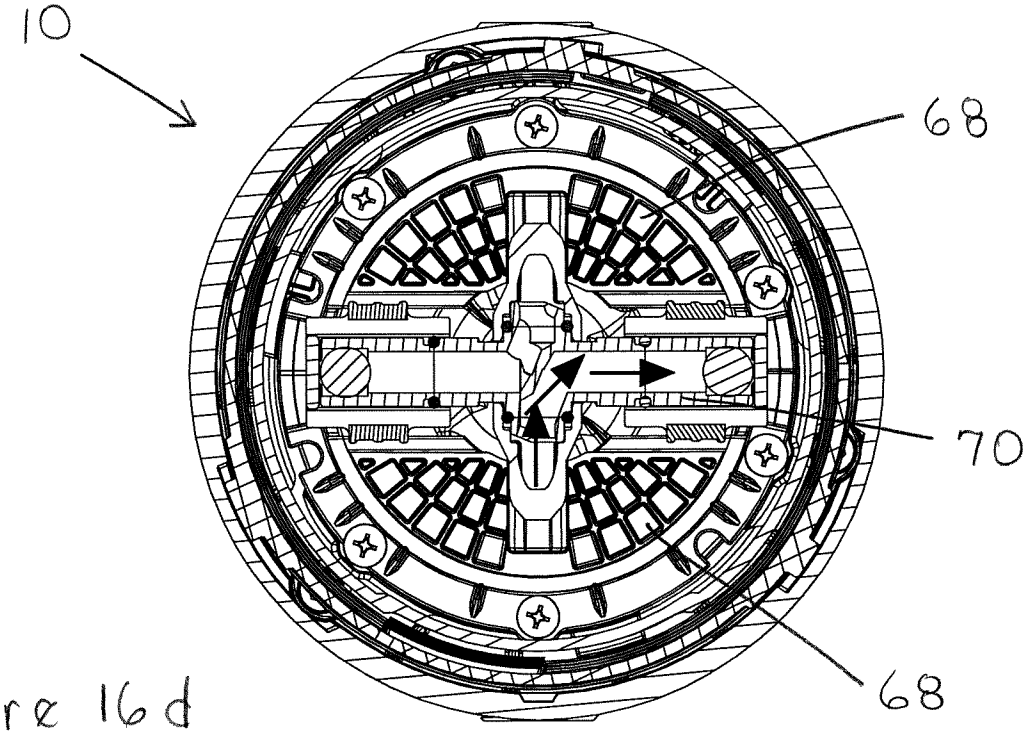
Figure 17A:
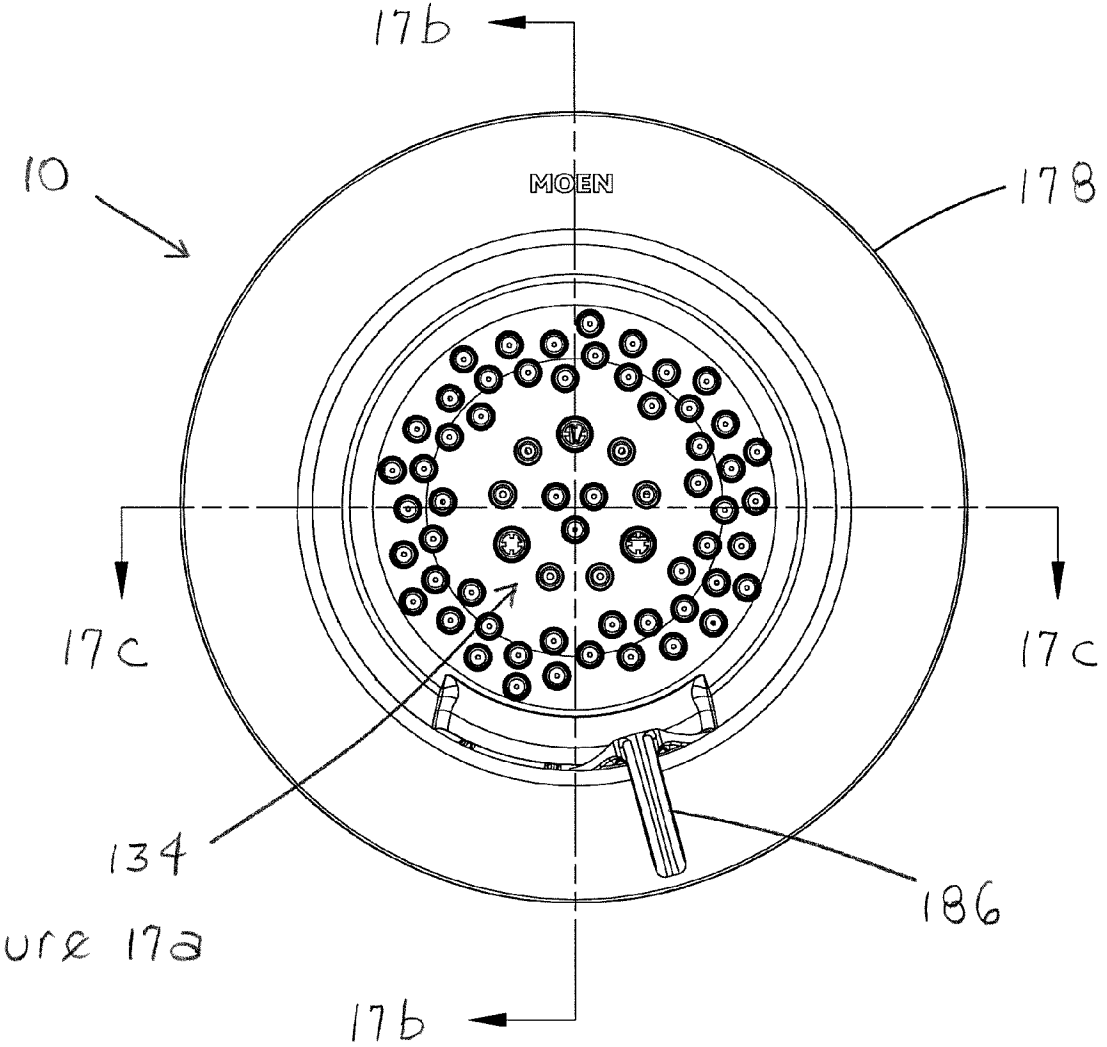
FIGS. 17*a*-17*d* are views of the assembled body spray of FIG. 1 in a massage mode
Figure 17B:
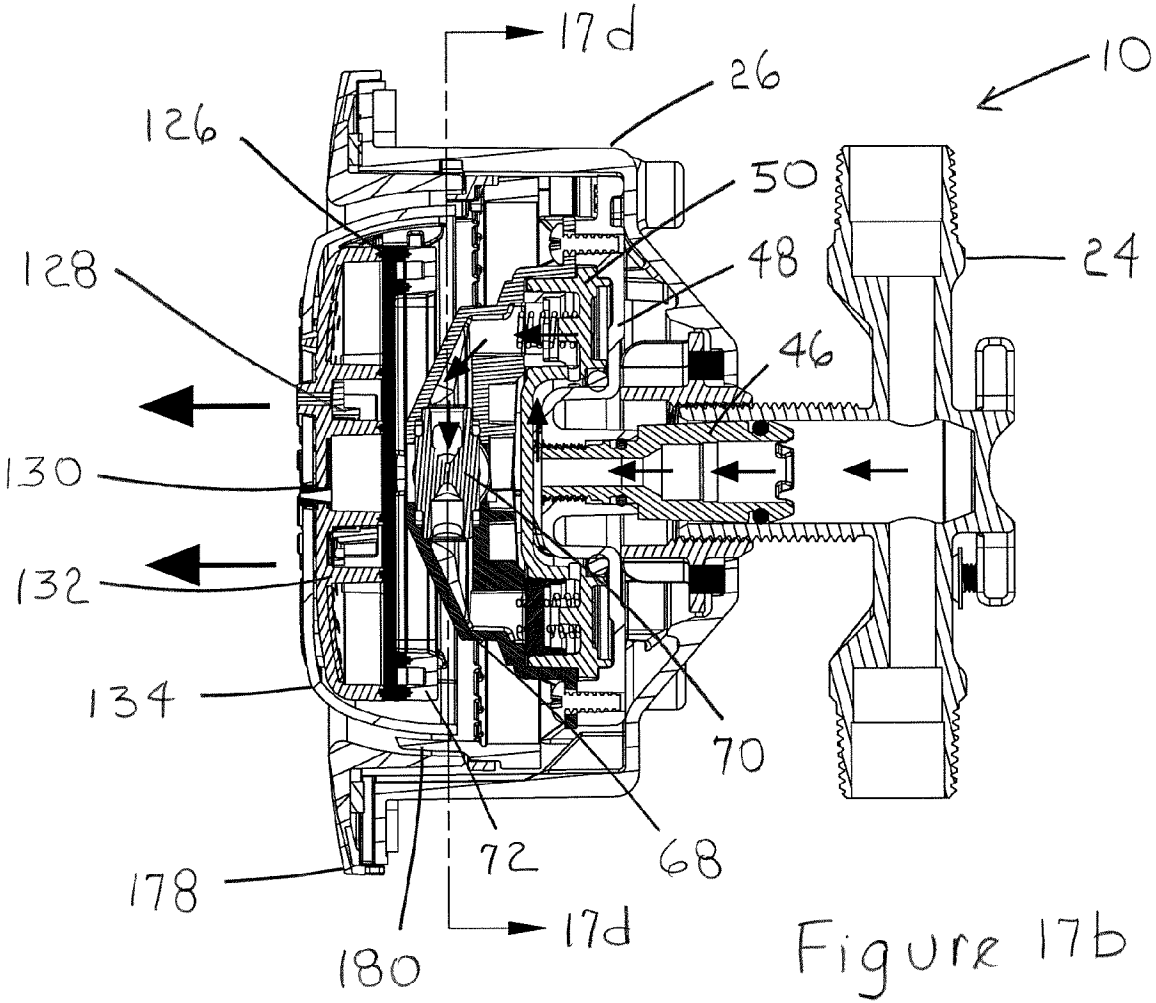
Figure 17C:
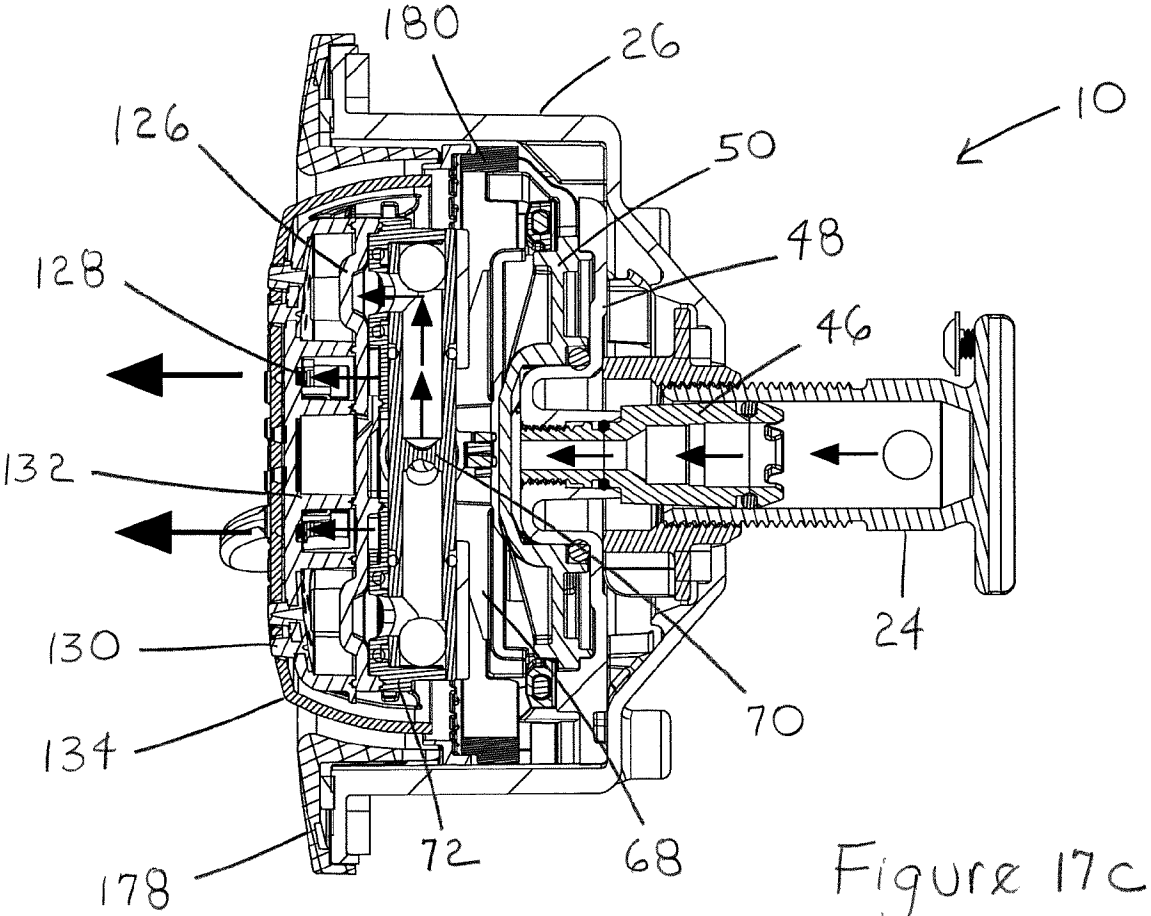
Figure 17D:
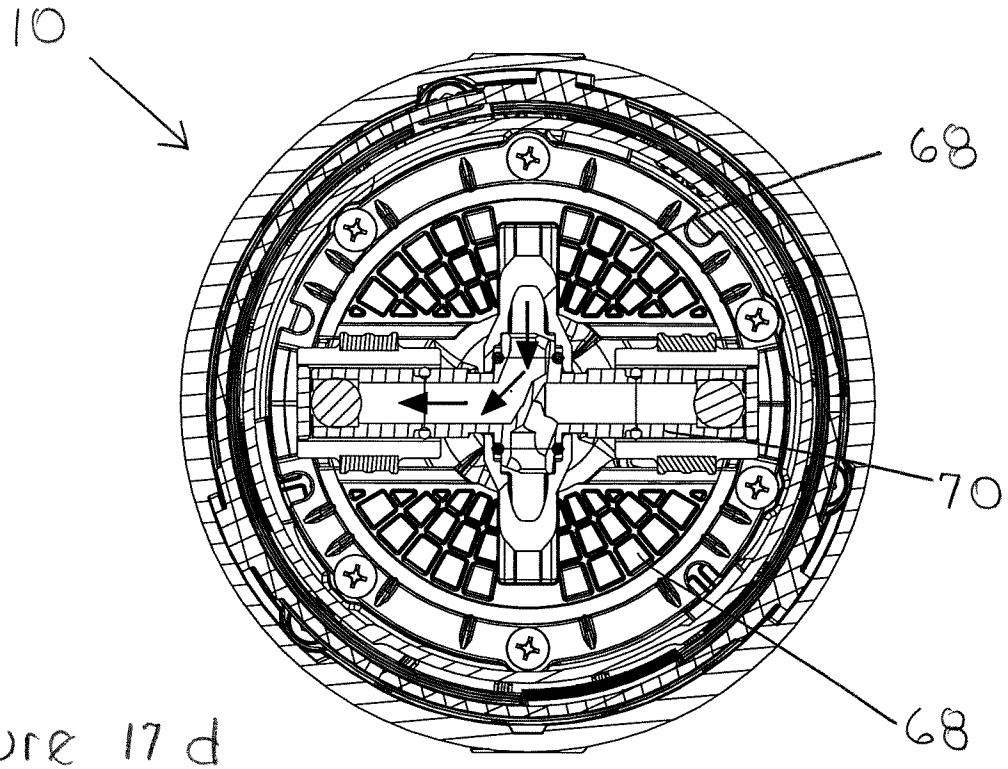
Figure 18A:
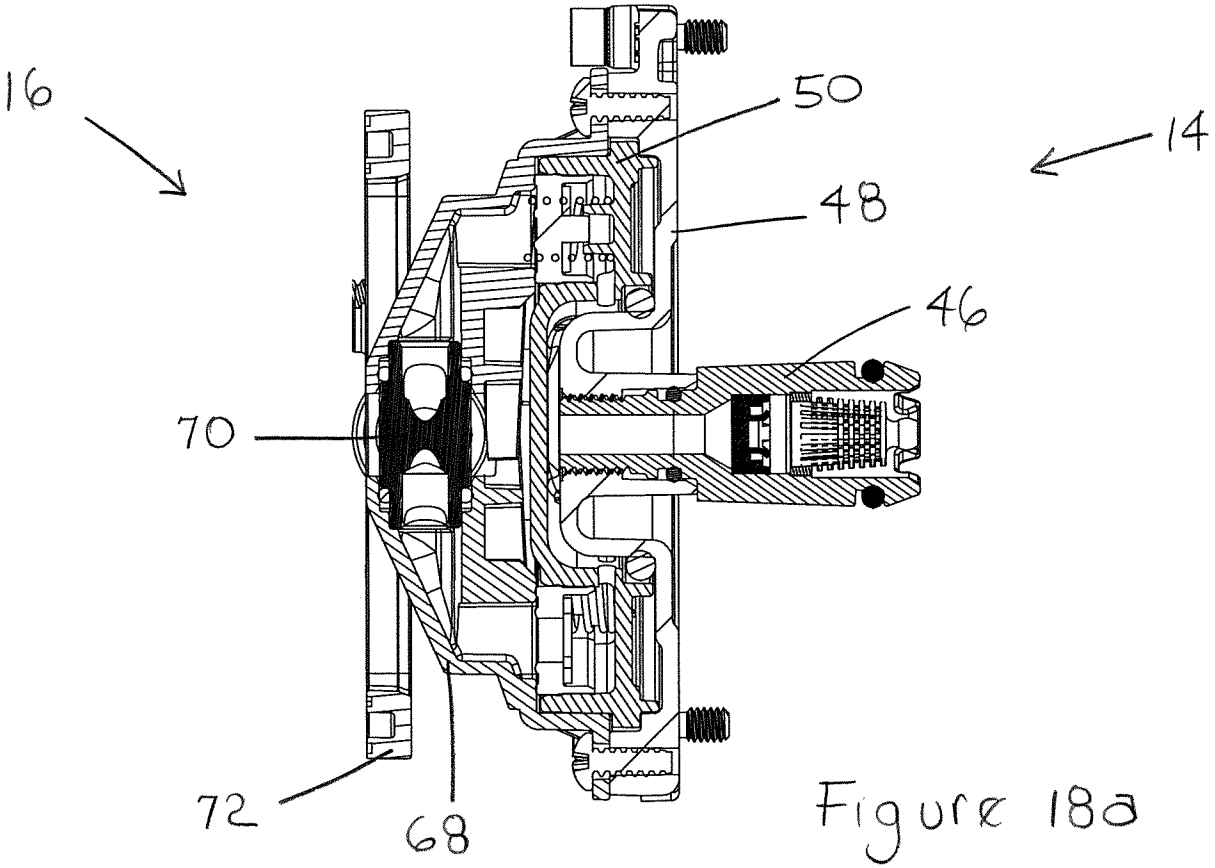
FIGS. 18*a*-18*b* are views of the assembled diverter assembly and pivot assembly of the body spray of FIG. 1
Figure 18B:
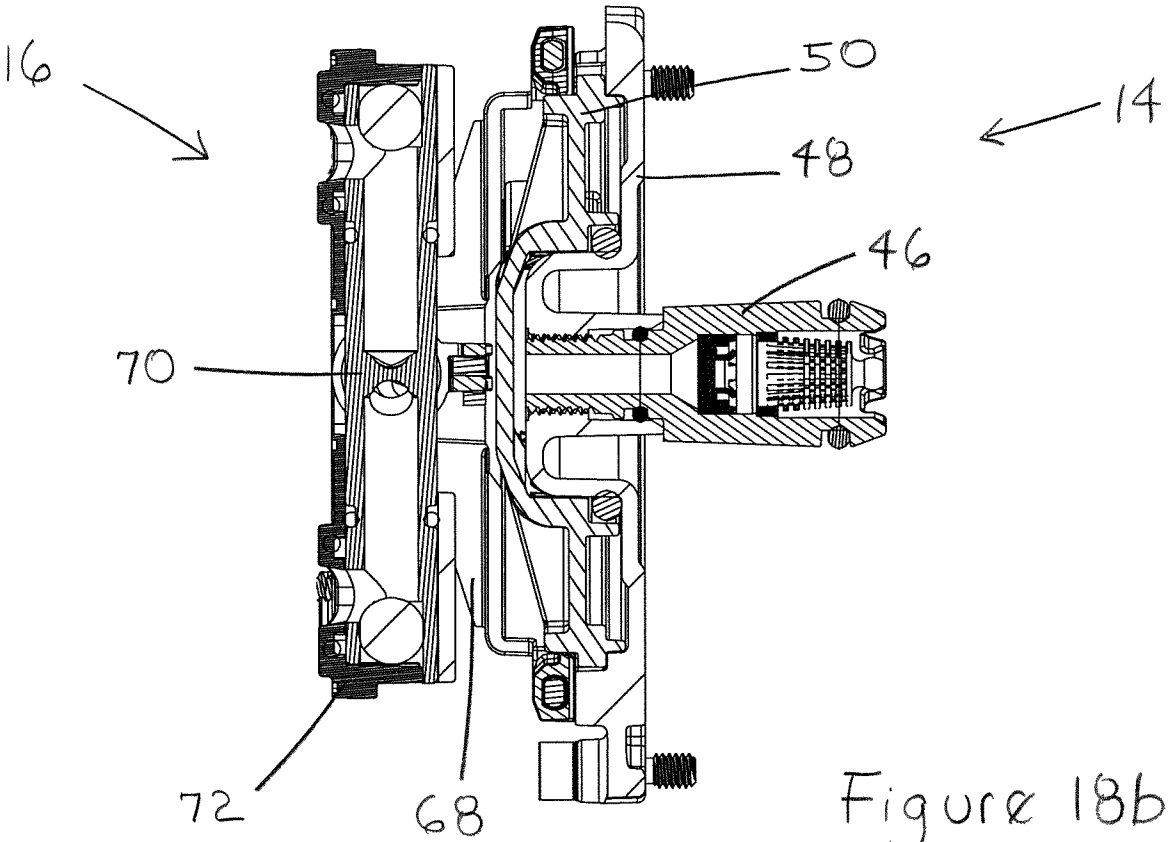

Exemplary embodiments of the escutcheon assembly 20 are shown in detail in FIGS. 1 and 14-15. In the illustrated embodiment of FIG. 14, the escutcheon assembly 20 includes an actuator mechanism 176 and an escutcheon 178. The actuator mechanism 176 is operable to interface with the diverter mechanism 44. The escutcheon 178 is operable to interface with the housing 26.

In the illustrated embodiment of FIGS. 1 and 15, the escutcheon assembly 20 includes an actuator ring 180 and the escutcheon 178. The actuator ring 180 includes an inner surface 182 with a plurality of grooves 184 therein. The grooves 184 on the inner surface 182 of the actuator ring 180 interface with the projections 60 extending from the outer ring 58 of the rotor plate 50. The actuator ring 180 includes a lever 186. The escutcheon 178 includes a central opening 188. The escutcheon 178 includes a rear surface 190 with a flange 192 projecting therefrom. The flange 192 on the escutcheon 178 interfaces with the housing 26. In the illustrated embodiment of FIGS. 1 and 15, the actuator mechanism 176 includes the actuator ring 180.

During assembly of the illustrated embodiment of FIG. 1, the pivot assembly 16 and the spray assembly 18 are preassembled. Exemplary assembly steps will be described. The turbine 128 and the nubbin plate 130 are placed between the rear plate 126 and the front plate 132. In an exemplary embodiment, the nubbin plate 130 is overmolded onto the front plate 132 during manufacture, and the turbine 128 is placed between the rear plate 126 and the front plate 132 with the nubbin plate 130 overmolded thereon. The pivot plate 72, the rear plate 126, and the front plate 132 are attached to one another by welding or other conventional means. Gaskets 194 are placed in the recess 114 in the pivot plate 72. O-rings 196 are placed on the pivot 70. The pivot 70 is placed in the recess 114 in the pivot plate 72 with the gaskets 194 therein. Clamps 198 are placed over the pivot 70 and attached to the rear plate 72 using screws 200 or other conventional fasteners. The first arm 82 of the first portion 74 of the pivot support 68 and the second arm 84 of the second portion 76 of the pivot support 68 are placed over the first port 96 of the pivot body 90 and the second port 98 of the pivot body 90, respectively. The first portion 74 and the second portion 76 of the pivot support 68 are aligned with each other by mating structural features 202 or other conventional alignment mechanisms.

Additionally, during assembly of the illustrated embodiment of FIG. 1, the diverter assembly 14 is preassembled. Exemplary assembly steps will be described. O-rings 204 are placed on the stem 46. In an exemplary embodiment, a screen 206 and a flow restrictor 208 are inserted into the stem 46. The stem 46 is inserted into the central opening 52 in the mounting plate 48. An O-ring 210, seal springs 212, spring plates 214, and cup seals 216 are placed on the rotor plate 50. The rotor plate 50 is placed on the mounting plate 48.

Further, during assembly of the illustrated embodiment of FIG. 1, the subassembly of the pivot assembly 16 and the spray assembly 18 is assembled to the diverter assembly 14. Exemplary assembly steps will be described. The pivot support 68 is placed on the rotor plate 50. The pivot support 68 is attached to the mounting plate 48 using screws 218 or other conventional fasteners. The spray face 134 is placed over the front plate 132. The spray face 134 is attached to the pivot plate 72 using screws 220 or other conventional fasteners.

Additionally, during assembly of the illustrated embodiment of FIG. 1, the escutcheon assembly 20 is preassembled. Exemplary assembly steps will be described. A bearing 222 is placed on the actuator ring 180. The actuator ring 180 is placed inside the escutcheon 178.

During installation of the illustrated embodiment of FIG. 1, the housing assembly 12 is mounted. Exemplary installation steps will be described. The bracket 22 is attached to a support behind a mounting surface, such as a stud in a wall, using screws (not shown) or other conventional fasteners. In the illustrated embodiment, the bracket 22 is installed in a generally horizontal orientation. Alternatively, the bracket 22 could be attached to a horizontal support behind a mounting surface. In that embodiment, the bracket 22 would be installed in a generally vertical orientation. The flange 34 on the connector 24 is inserted into the channel 28 on the bracket 22. The flange 34 on the connector 24 is moved in the channel 28 on the bracket 28 until the connector 24 is in a desired position. Once in the desired position, the flange 34 on the connector 24 is secured in the channel 28 on the bracket 22 using screws 224 or other conventional fasteners. The housing 26 is placed over the horizontal port 30 of the connector 24. A seal (not shown) is placed over the horizontal port 30 of the connector 24. The housing 26 is attached to the connector 24 using a nut 226 or other conventional fastener.

Additionally, during installation of the illustrated embodiment of FIG. 1, the diverter assembly 14, the pivot assembly 16, and the spray assembly 18 (already preassembled) are attached to the housing assembly 12. Exemplary installation steps will be described. The stem 46 is inserted through the opening in the housing 26 and into the horizontal port 30 of the connector 24. The mounting plate 48 is attached to the housing 26 using screws 228 or other conventional fasteners.

Further, during installation of the illustrated embodiment of FIG. 1, the escutcheon assembly 20 is installed around the spray face 134 of the spray assembly 18. Exemplary installation steps will be described. The actuator ring 180 is placed around the spray face 134. The actuator ring 180 is engaged with the rotor plate 50 using the grooves 184 in the inner surface 182 of the actuator ring 180 and the projections 60 on the rotor plate 50. The escutcheon 178 is attached to the housing 26.

During operation of the illustrated embodiment of FIG. 1, water flows from the water supply into the body spray 10. Depending on the mode selected, water will continue through and exit the body spray 10 as a spray or a massage. The mode is selected by using the lever 186 to rotate the actuator ring 180. Rotation of the actuator ring 180 causes rotation of the rotor plate 50. In one position of the actuator ring 180 and the rotor plate 50, the spray mode is selected and, in another position of the actuator ring 180 and the rotor plate 50, the massage mode is selected. Although the body spray 10 has been shown and described as having a spray mode and a massage mode, one of ordinary skill in the art will appreciate that the body spray 10 could have a spray mode, a massage mode, and a combined spray/massage mode.

In the spray mode of the illustrated embodiment of FIG. 1, as illustrated in FIGS. 16*a*-16*d*, water flows through the components of the body spray 10 in the following order: (1) the stem 46, (2) the central opening 52 in the mounting plate 48, (3) the first opening 54 in the rotor plate 50, (4) the first opening 78 in the first portion 74 of the pivot support 68, (5) the first passageway 86 of the first arm 82 of the first portion 74 of the pivot support 68, (6) the first port 96 of the pivot body 90, (7) the first passageway 102 of the pivot body 90, (8) the first opening 106 in the pivot body 90, (9) the first opening 116 in the recess 114 of the pivot plate 72, (10) the two openings 136 near the perimeter 138 of and the central opening 140 in the rear plate 126, and (11) the nubbins 148 in the central portion 144 and the nubbins 150 in the outer ring 146 of the nubbin plate 130.

In the massage mode of the illustrated embodiment of FIG. 1, as illustrated in FIGS. 17*a*-17*d*, water flows through the components of the body spray 10 in the following order: (1) the stem 46, (2) the central opening 52 in the mounting plate 48, (3) the second opening 56 in the rotor plate 50, (4) the second opening 80 in the second portion 76 of the pivot support 68, (5) the second passageway 88 of the second arm 84 of the second portion 76 of the pivot support 68, (6) the second port 98 of the pivot body 90, (7) the second passageway 104 of the pivot body 90, (8) the second opening 110 in the pivot body 90, (9) the second opening 118 in the recess 114 of the pivot plate 72, (10) the two openings 142 offset from the central opening 140 in the rear plate 126, (11) the turbine 128, and (12) the nozzles 160 in the middle ring 154 of the front plate 132.

Additionally, during operation of the illustrated embodiment of FIG. 1, the spray face 134 is pivoted to direct the nubbins 148 in the central portion 144 and the nubbins 150 in the outer ring 146 of the nubbin plate 130 and the nozzles 160 in the middle ring 154 of the front plate 132 in any direction desired by the user. More specifically, when the user presses on any point on the spray face 134 other than a center of the spray face 134, the spray face 134 pivots along the first axis 62 and/or the second axis 64. As a result, the spray face 134 can be pivoted so that a plane of the spray face 134 is no longer parallel to a plane of the mounting surface.

In an exemplary embodiment, the diverter assembly 14 is upstream of and operates independently of the pivot assembly 16. The assembled diverter assembly 14 and pivot assembly 16 are shown in detail separate from the other components of the body spray 10 in FIGS. 18*a*-18*b*.

Because the diverter assembly 14 is upstream of and operates independently of the pivot assembly 16, switching of the body spray 10 from one mode to another mode will not cause inadvertent pivoting of the spray face 134. Similarly, pivoting of the spray face 134 will not cause inadvertent switching of the body spray 10 from one mode to another mode.

Additionally, in an exemplary embodiment, the diverter assembly 14 diverts fluid flow between the first set of nozzles 120 and the second set of nozzles 122 upon actuation of the diverter mechanism 44. More specifically, the diverter assembly 14 diverts fluid flow between the first set of nozzles 120 and the second set of nozzles 122 upon movement of the actuator mechanism 176 which results in actuation of the diverter mechanism 44.

Further, in an exemplary embodiment, the spray assembly 18 moves the first set of nozzles 120 and the second set of nozzles 122 from a first spray direction to a second spray direction upon actuation of the pivot mechanism 66. More specifically, the spray assembly 18 moves the first set of nozzles 120 and the second set of nozzles 122 from a first spray direction to a second spray direction upon movement of the spray head mechanism 124 which results in actuation of the pivot mechanism 66.

While the body spray 10 has been shown and described in the illustrated embodiment as including certain components, one of ordinary skill in the art will appreciate that the body spray 10 does not need to include each of these components.

While the body spray 10 has been shown and described in the illustrated embodiment with the components attached or engaged in a particular manner, one of ordinary skill in the art will appreciate that the components of the body spray 10 do not need to be attached in this particular manner.

As an example, in the illustrated embodiment, the diverter assembly 14 has been shown and described as including a diverter mechanism 44 that is operated by rotation of the actuator ring 180. However, one of ordinary skill in the art will appreciate that the diverter mechanism 44 could be operated by other motions, such as a linear pushing or pulling motion of an actuator button or knob.

As another example, in the illustrated embodiment, the pivot assembly 16 has been shown and described as having fluid flowing through it. However, one of ordinary skill in the art will appreciate that the fluid could flow around the pivot assembly 16.

As another example, in the illustrated embodiment, the pivot assembly 16 has been shown and described as including a pivot support 68, a pivot 70, and a pivot plate 72. However, one of ordinary skill in the art will appreciate that the pivot assembly 16 could include spherical structure, such as a ball.

One of ordinary skill in the art will now appreciate that the present invention provides a multifunction pivoting body spray whose diverter assembly is upstream of and operates independently of its pivot assembly. Although the present invention has been shown and described with reference to a particular embodiment, equivalent alterations and modifications will occur to those skilled in the art upon reading and understanding this specification. The present invention includes all such equivalent alterations and modifications and is limited only by the scope of the following claims in light of their full scope of equivalents.

What is claimed is:

1. A multifunction pivoting body spray, the body spray comprising:

a diverter assembly including a first flow path, a second flow path, and a diverter mechanism, the diverter mechanism being operable to divert fluid flow between the first flow path and the second flow path; and a pivot assembly including a first pivot axis, a second pivot axis, and a pivot mechanism, the pivot mechanism being operable to pivot on the first pivot axis and the second pivot axis;

wherein the diverter assembly is upstream of the pivot assembly;

wherein the diverter assembly operates independently of the pivot assembly;

wherein the diverter mechanism includes a rotor plate; and wherein the rotor plate includes an outer ring with a plurality of projections extending therefrom.

2. A multifunction pivoting body spray, the body spray comprising:

a diverter assembly including a first flow path, a second flow path, and a diverter mechanism, the diverter mechanism being operable to divert fluid flow between the first flow path and the second flow path; and a pivot assembly including a first pivot axis, a second pivot axis, and a pivot mechanism, the pivot mechanism being operable to pivot on the first pivot axis and the second pivot axis;

wherein the diverter assembly is upstream of the pivot assembly;

wherein the diverter assembly operates independently of the pivot assembly;

wherein the pivot mechanism includes a pivot support, a pivot, and a pivot plate;

wherein the pivot support includes a first portion and a second portion;

wherein the first portion includes a first opening, a first arm, and a first passageway through the first arm;

wherein the second portion includes a second opening, a second arm, and a second passageway through the second arm;

wherein the first passageway of the first arm communicates with the first opening in the first portion; and wherein the second passageway of the second arm communicates with the second opening in the second portion.

3. A multifunction pivoting body spray, the body spray comprising:

a diverter assembly including a first flow path, a second flow path, and a diverter mechanism, the diverter mechanism being operable to divert fluid flow between the first flow path and the second flow path; and a pivot assembly including a first pivot axis, a second pivot axis, and a pivot mechanism, the pivot mechanism being operable to pivot on the first pivot axis and the second pivot axis;

wherein the diverter assembly is upstream of the pivot assembly;

wherein the diverter assembly operates independently of the pivot assembly;

wherein the pivot mechanism includes a pivot support, a pivot, and a pivot plate;

wherein the pivot includes:

a generally cylindrical portion having a first port and a second port;

a first passageway that communicates with the first port;

a second passageway that communicates with the second port;

a first opening that communicates with the first passageway; and a second opening that communicates with the second passageway.

4. A multifunction pivoting body spray, the body spray including:

a housing assembly including a housing;

a diverter assembly including a first flow path, a second flow path, and a diverter mechanism, the diverter mechanism being operable to divert fluid flow between the first flow path and the second flow path;

a pivot assembly including a first pivot axis, a second pivot axis, and a pivot mechanism, the pivot mechanism being operable to pivot on the first pivot axis and the second pivot axis;

a spray assembly including a first set of nozzles, a second set of nozzles, and a spray head mechanism, the first set of nozzles being operable to receive fluid flow from the first flow path of the diverter assembly and deliver a first type of spray from the spray assembly, the second set of nozzles being operable to receive fluid flow from the second flow path of the diverter assembly and deliver a second type of spray from the spray assembly, and the spray head mechanism being operable to direct the first set of nozzles and the second set of nozzles in a plurality of spray directions; and an escutcheon assembly including an escutcheon and an actuator mechanism, the escutcheon being operable to interface with the housing, the actuator mechanism being operable to interface with the diverter mechanism;

wherein the diverter assembly diverts fluid flow between the first set of nozzles and the second set of nozzles upon movement of the actuator mechanism which results in actuation of the diverter mechanism;

wherein the spray assembly moves the first set of nozzles and the second set of nozzles from a first spray direction to a second spray direction upon movement of the spray head mechanism which results in actuation of the pivot mechanism; and wherein the diverter assembly is upstream of the pivot assembly; and wherein the diverter assembly operates independently of the pivot assembly.

5. The multifunction pivoting body spray of claim 4, wherein the diverter mechanism includes a rotor plate.

6. The multifunction pivoting body spray of claim 4, wherein the pivot mechanism includes a pivot support, a pivot, and a pivot plate.

7. The multifunction pivoting body spray of claim 4, wherein the spray head mechanism includes a spray face.

8. The multifunction pivoting body spray of claim 4, wherein the actuator mechanism includes an actuator ring.

9. The multifunction pivoting body spray of claim 8, wherein the actuator ring includes an inner surface with a plurality of grooves therein.

* * * * *